US009863691B2

(12) United States Patent
Kikuchi et al.

(10) Patent No.: US 9,863,691 B2
(45) Date of Patent: Jan. 9, 2018

(54) REFRIGERATOR

(71) Applicant: SAMSUNG ELECTRONICS CO., LTD., Suwon-si, Gyeonggi-do (KR)

(72) Inventors: Manabu Kikuchi, Minoo (JP); Toshiaki Suzuki, Minoo (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/030,295

(22) PCT Filed: Oct. 17, 2014

(86) PCT No.: PCT/KR2014/009800

§ 371 (c)(1),
(2) Date: Apr. 18, 2016

(87) PCT Pub. No.: WO2015/057020

PCT Pub. Date: Apr. 23, 2015

(65) Prior Publication Data

US 2016/0252291 A1 Sep. 1, 2016

(30) Foreign Application Priority Data

Oct. 17, 2013 (JP) ..... 2013-216501
Dec. 16, 2013 (JP) ..... 2013-258967
(Continued)

(51) Int. Cl.
*F25D 23/02* (2006.01)
*E05D 3/02* (2006.01)
*E05D 11/06* (2006.01)

(52) U.S. Cl.
CPC ..... *F25D 23/028* (2013.01); *E05D 3/022* (2013.01); *E05D 11/06* (2013.01);
(Continued)

(58) Field of Classification Search
CPC ..... Y10T 16/539; Y10T 16/54038; Y10T 16/551; F25D 23/02; F25D 23/028;
(Continued)

(56) References Cited

U.S. PATENT DOCUMENTS 2,132,266 A * 10/1938 Lefevre ..... E05D 3/022 16/361
2,975,013 A 3/1961 Wallace et al.
(Continued)

FOREIGN PATENT DOCUMENTS

DE 1 914 503 4/1965
DE 1246457 B * 8/1967 ..... E05D 3/022
(Continued)

OTHER PUBLICATIONS

International Search Report dated Jan. 23, 2015, in corresponding International Application No. PCT/KR2014/009800.
(Continued)

*Primary Examiner* — Andrew M Roersma
(74) *Attorney, Agent, or Firm* — Staas & Halsey LLP

(57) ABSTRACT

A hinge device for a door of a refrigerator, etc. moves the center of rotation of the door by interlocking with the opening/closing operations of the door, while stabilizing the opening/closing operations without any hindrance such as rattling. The hinge device comprises: a shaft member which is mounted on a refrigerator main body and comprises a hinge pin; a bearing member which is mounted on a door and comprises a long hole which is in contact with the hinge pin to be relatively movable or relatively rotatable with respect to the hinge pin; and a cam which is installed on the hinge pin and constitutes a cam unit by contacting a cam follower of the bearing member.

11 Claims, 22 Drawing Sheets

(30) Foreign Application Priority Data

Aug. 18, 2014 (JP) ..... 2014-166133
Oct. 17, 2014 (KR) ..... 10-2014-0140625

(52) U.S. Cl.
CPC ... *E05Y 2201/638* (2013.01); *E05Y 2800/122* (2013.01); *E05Y 2800/422* (2013.01); *E05Y 2900/31* (2013.01); *F25D 2323/021* (2013.01); *F25D 2323/024* (2013.01)

(58) Field of Classification Search
CPC ..... F25D 2323/021; F25D 2323/024; E05D 3/022; E05Y 2900/31
See application file for complete search history.

(56) References Cited

U.S. PATENT DOCUMENTS 3,065,498 A * 11/1962 Johnson ..... E05D 1/04 16/359
4,609,234 A * 9/1986 Naniwa ..... E05D 3/022 16/341
5,931,554 A * 8/1999 Koopman ..... E05D 3/022 16/286
7,192,104 B2 * 3/2007 Tarantik ..... E05D 3/022 16/266
2006/0260097 A1 * 11/2006 Tate, Jr. ..... E05D 3/022 16/309

FOREIGN PATENT DOCUMENTS

DE 19800175 A1 * 7/1999 ..... E05D 11/06
EP 1 327 841 A2 7/2003
FR 2 501 274 9/1982
JP 2004301457 A * 10/2004 ..... F25D 23/02
JP 2009097812 A * 5/2009 ..... F25D 23/02
WO WO 2006/090958 A1 8/2006

OTHER PUBLICATIONS

Extended European Search Report dated Jan. 26, 2017 in corresponding European Patent Application No. 14854159.2.

* cited by examiner

[Fig. 1]
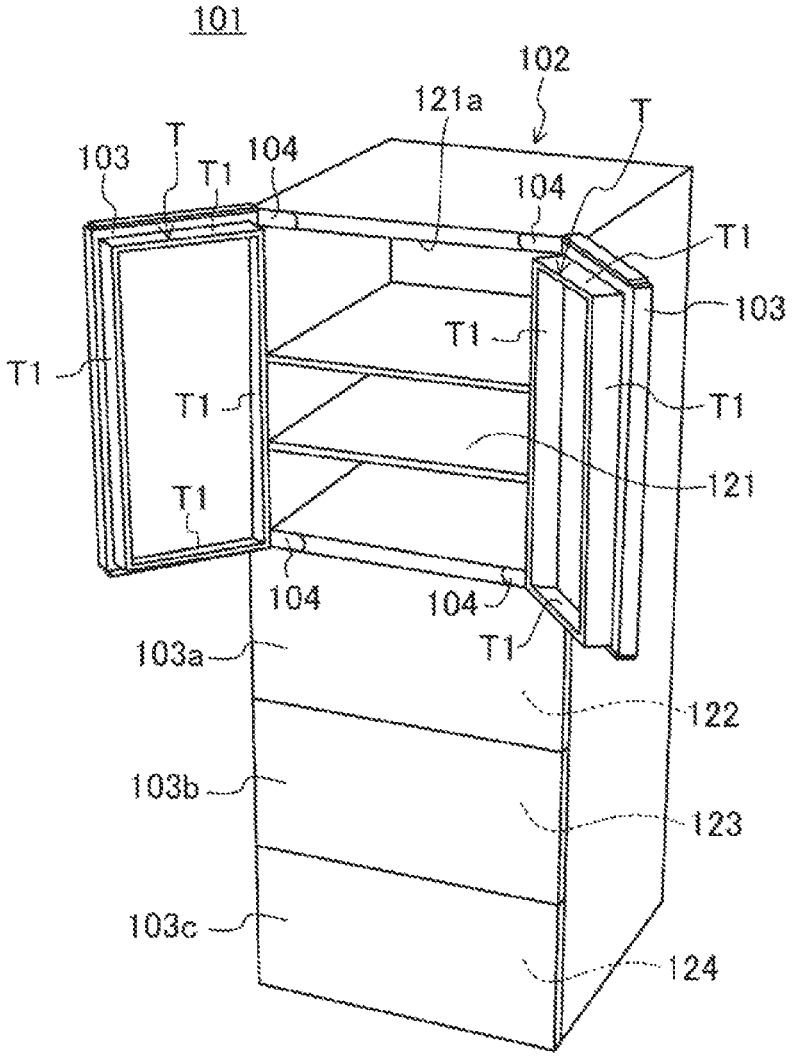

[Fig. 2]
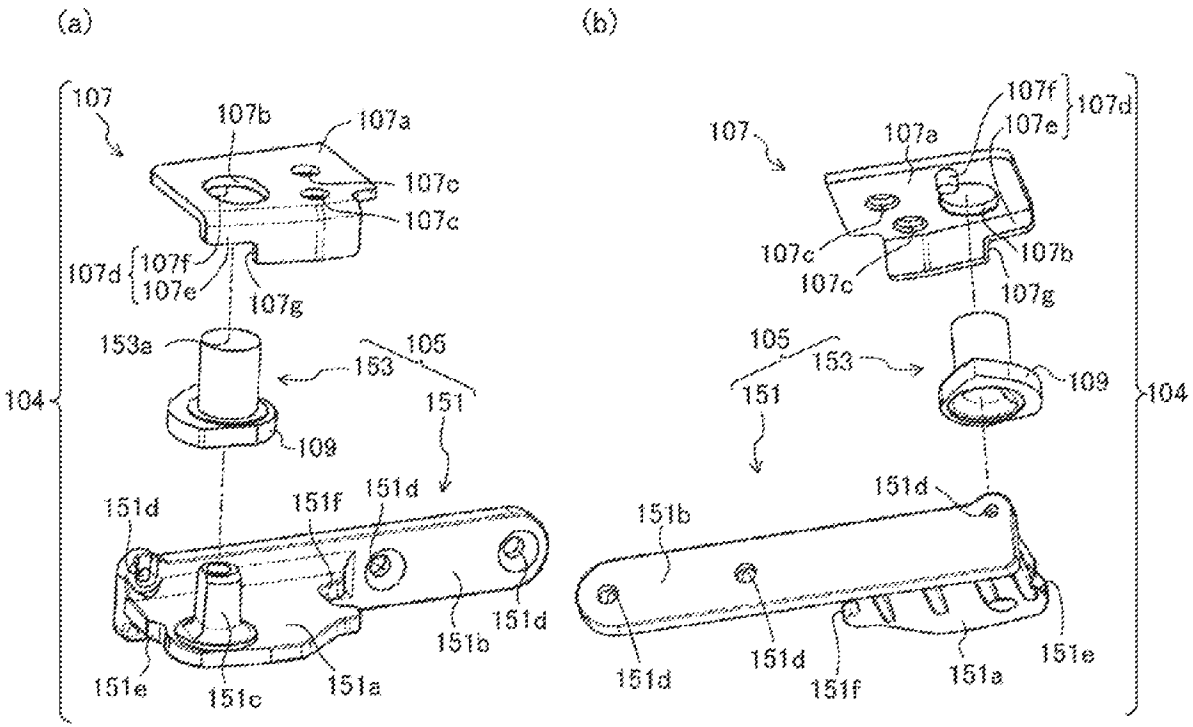

[Fig. 3]
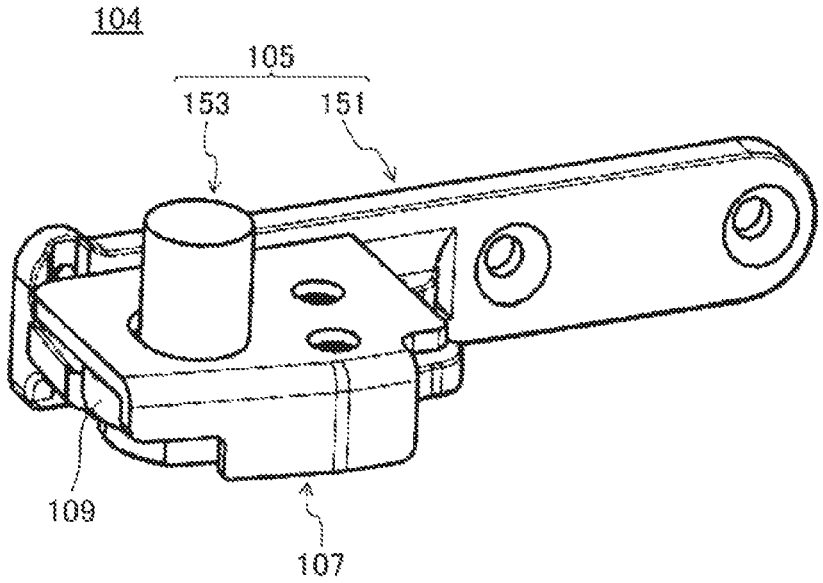

[Fig. 4]
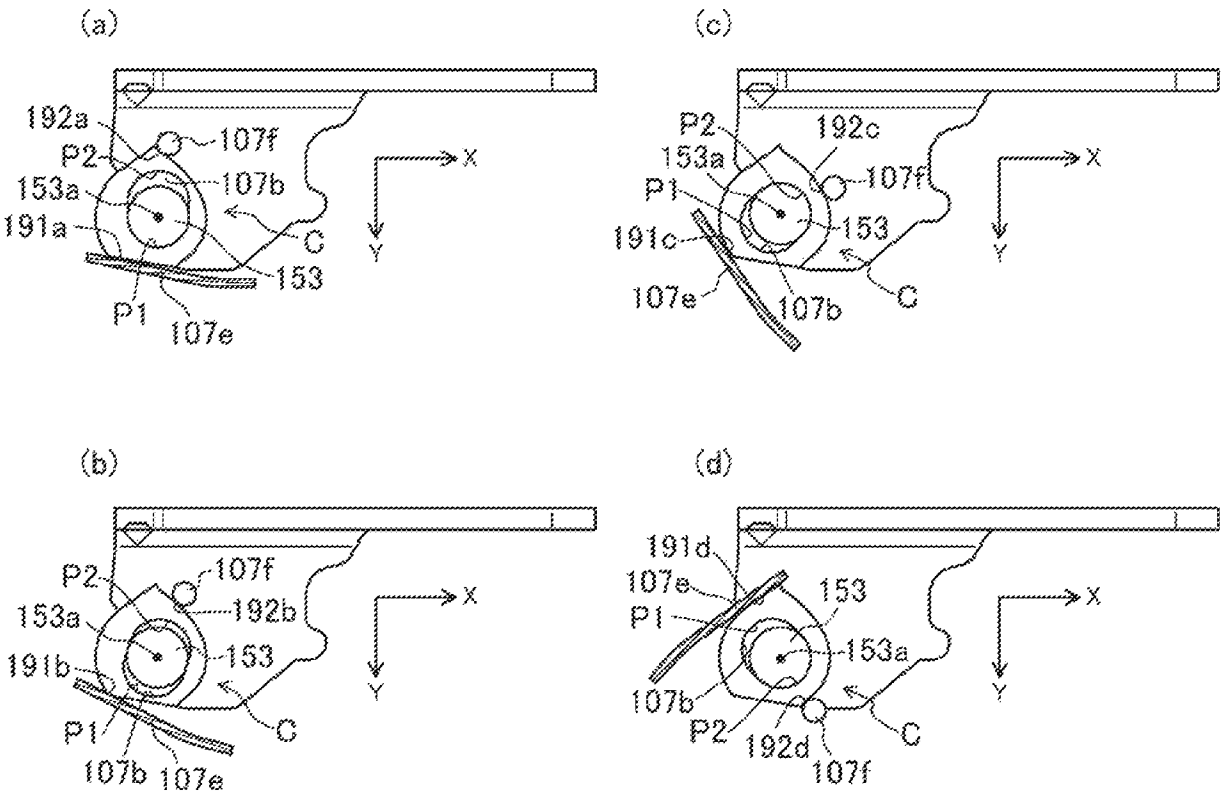

[Fig. 5]
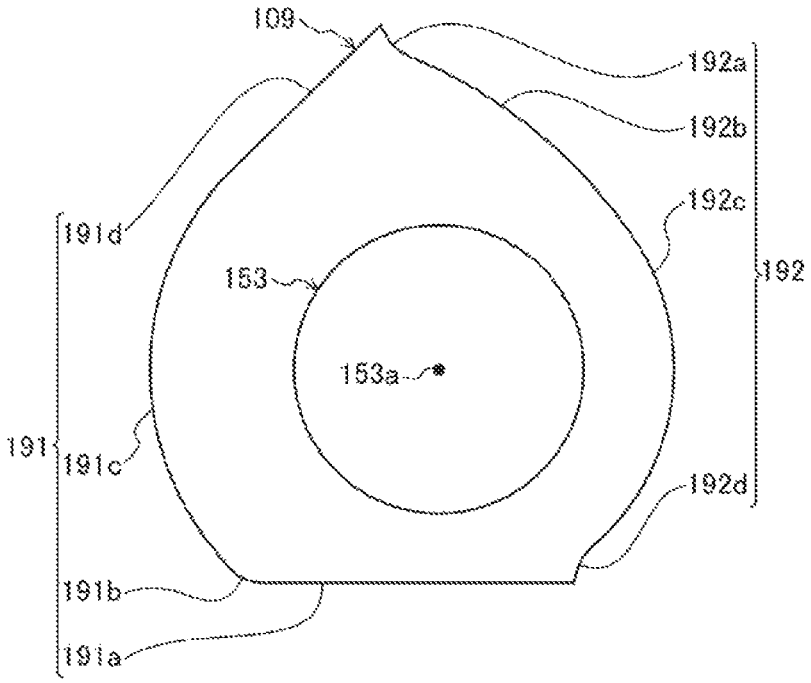
[Fig. 6]
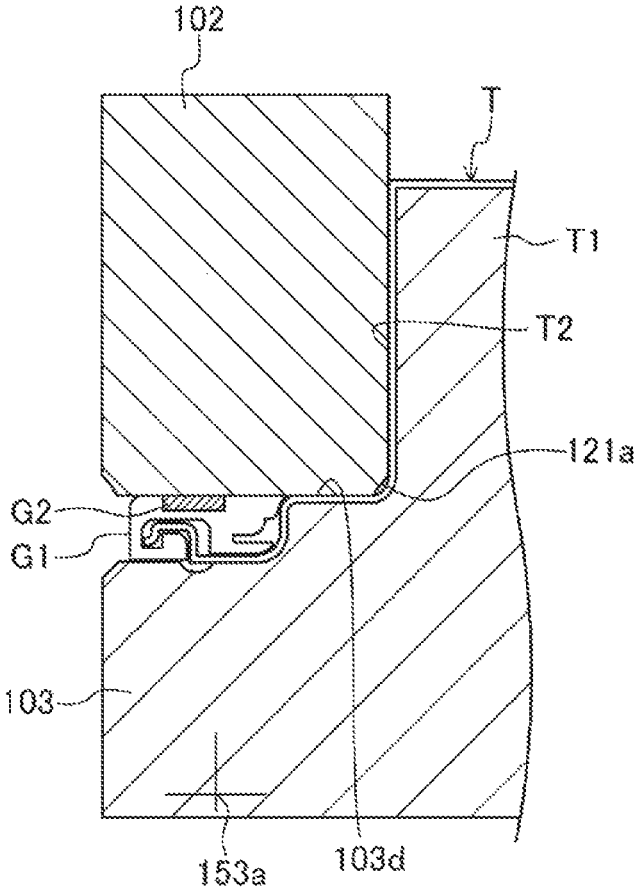

[Fig. 7]
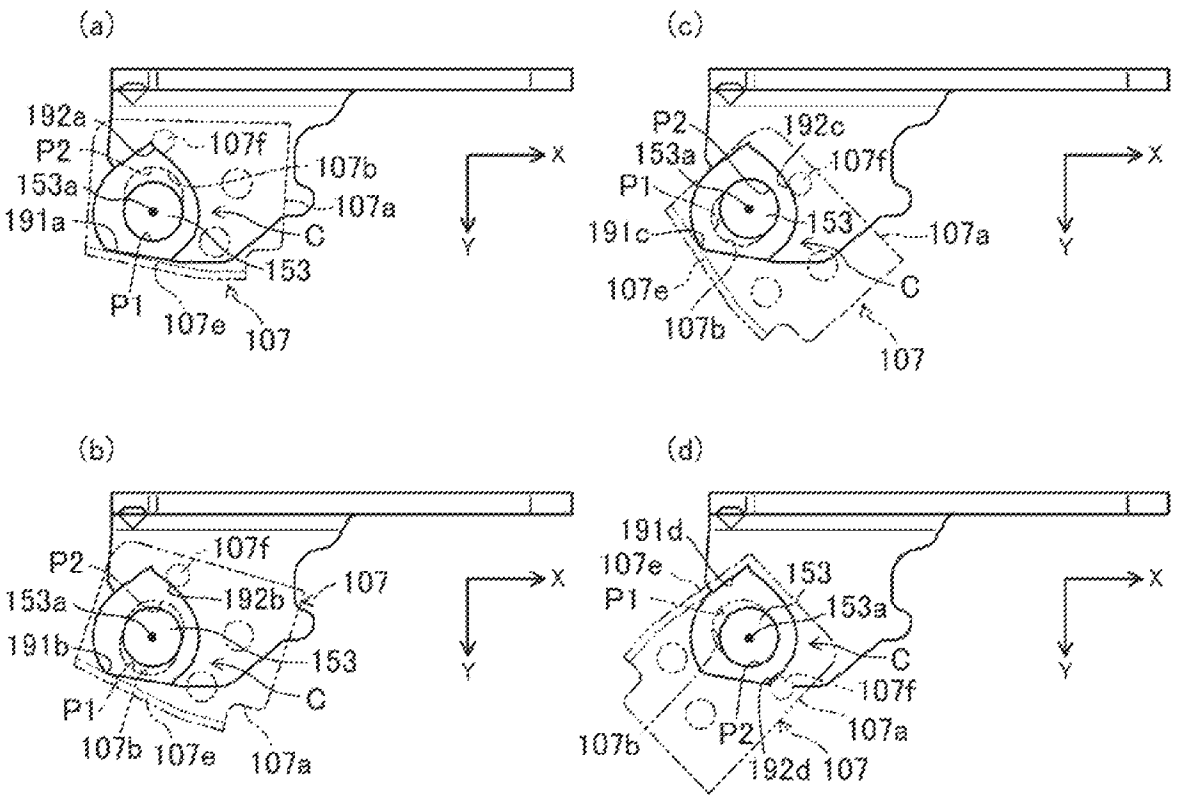

[Fig. 8]
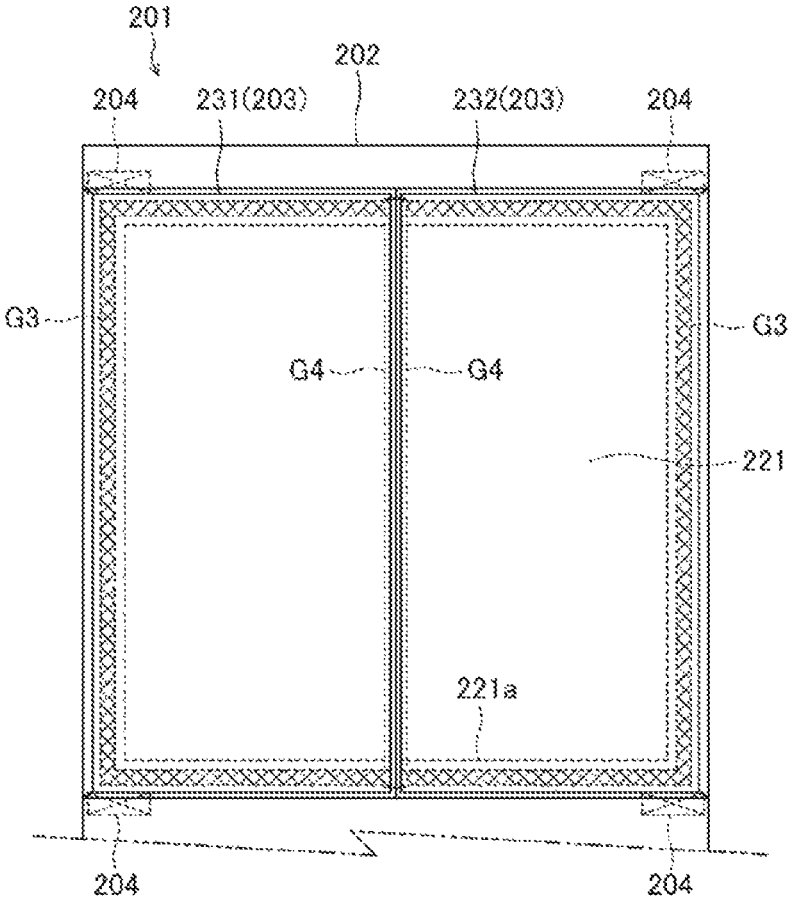
[Fig. 9]
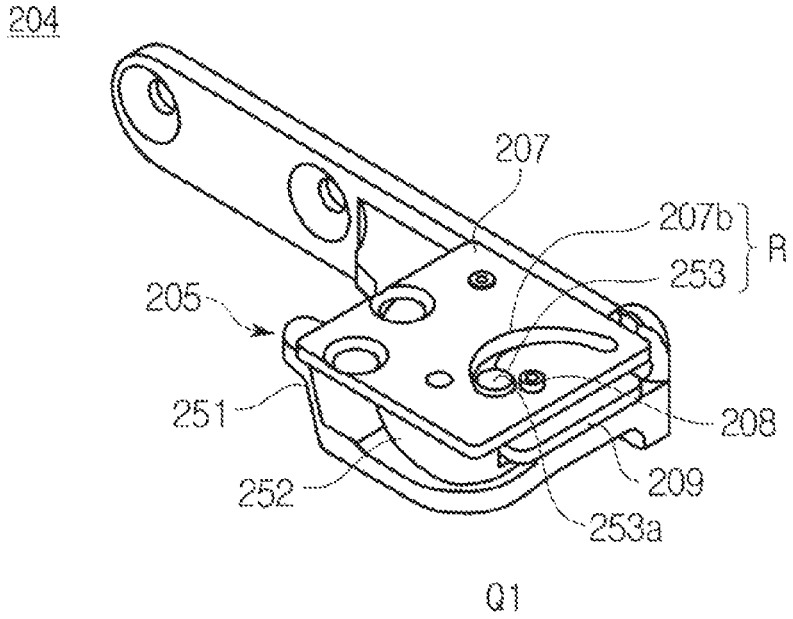

[Fig. 10]
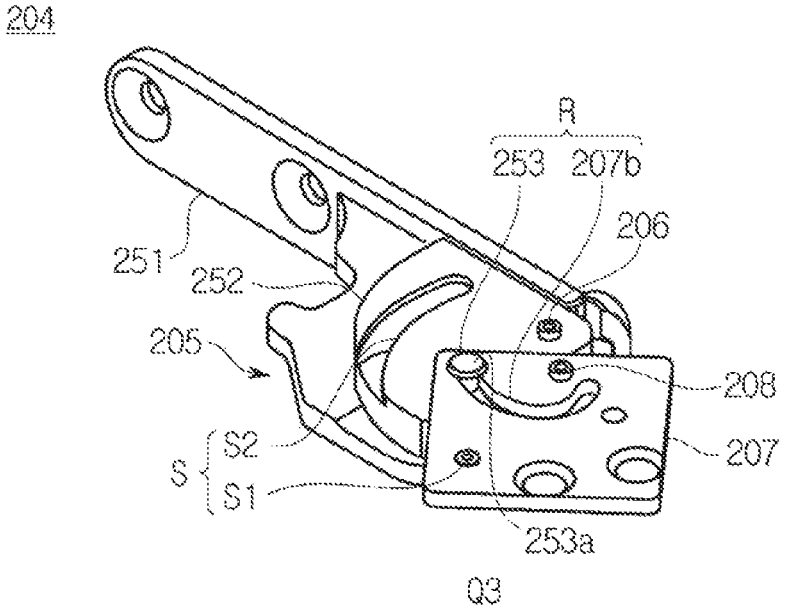
[Fig. 11]
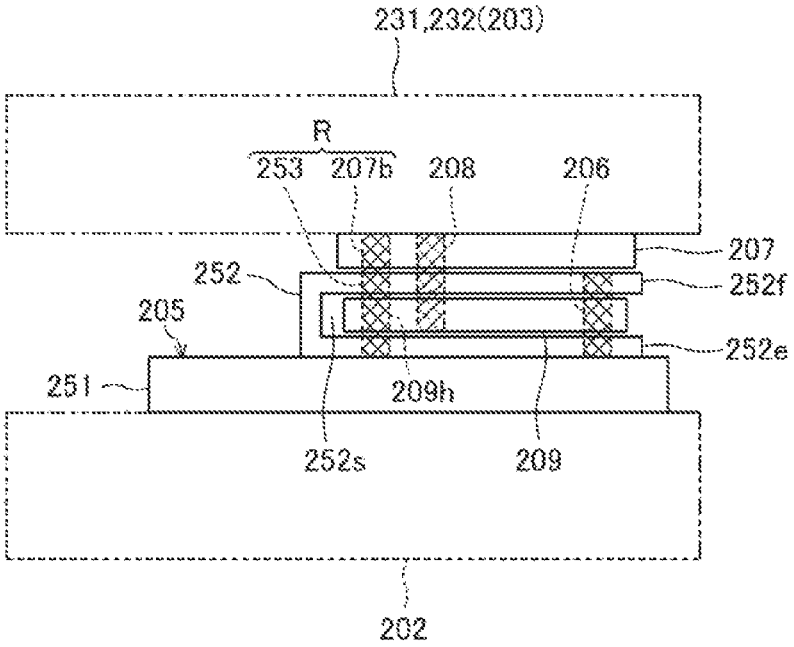

[Fig. 12]
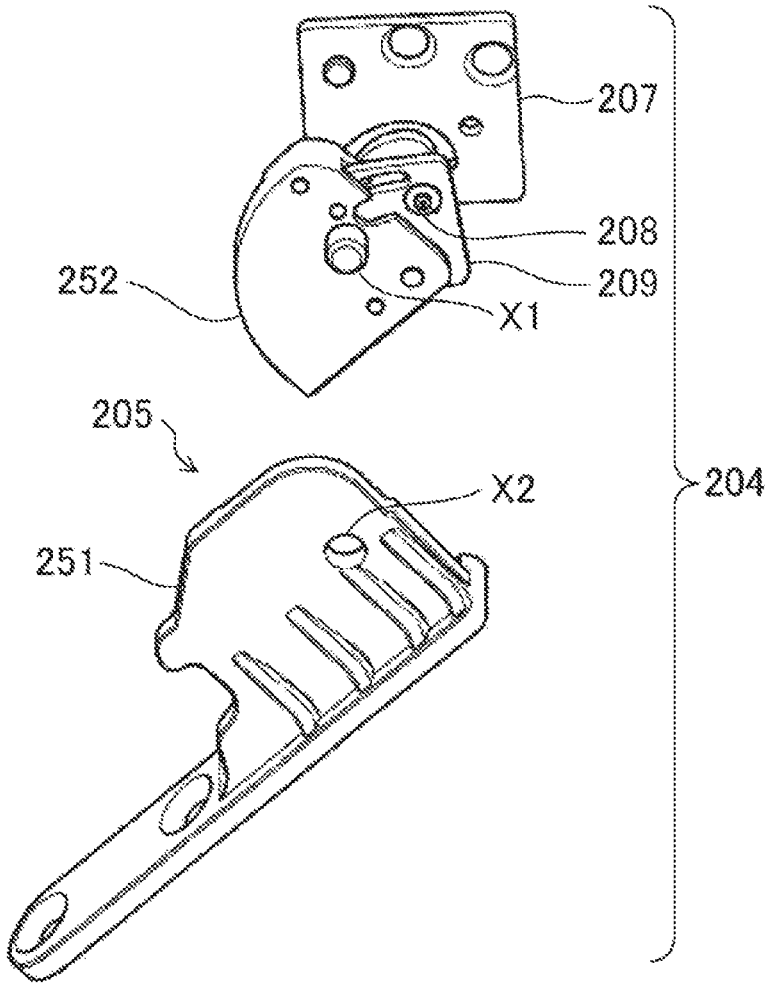

[Fig. 13]
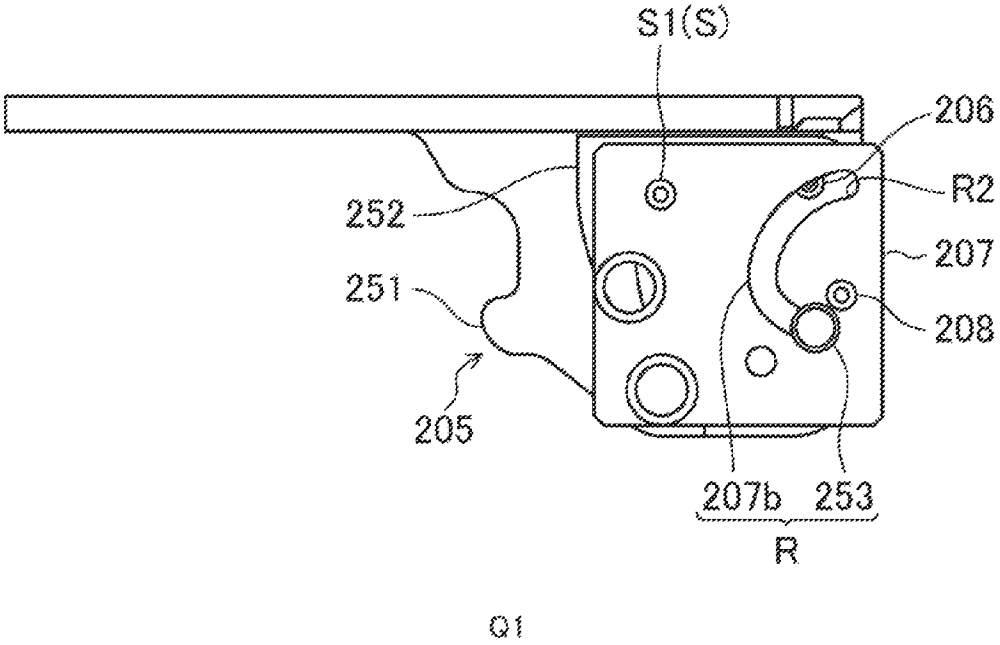

[Fig. 14]
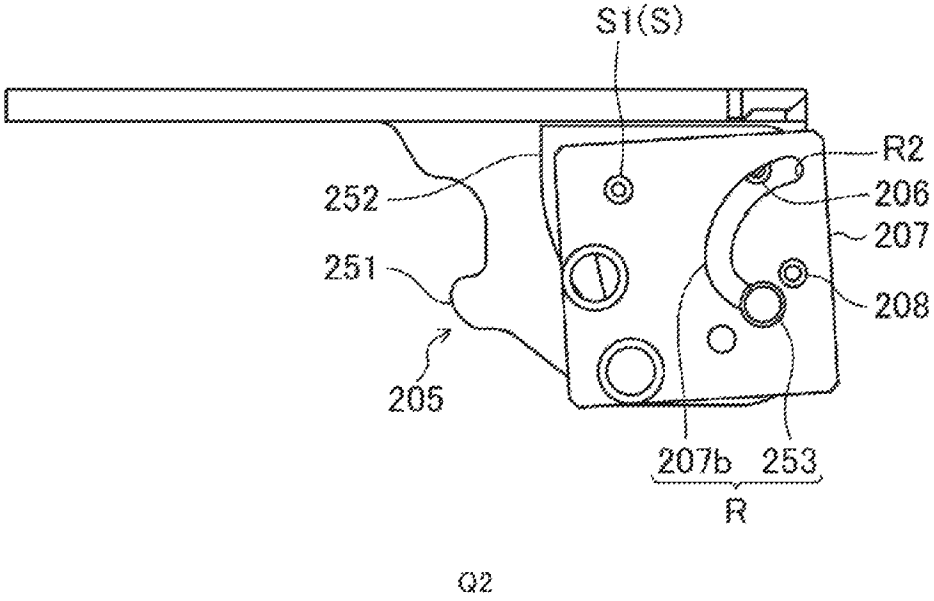

[Fig. 15]
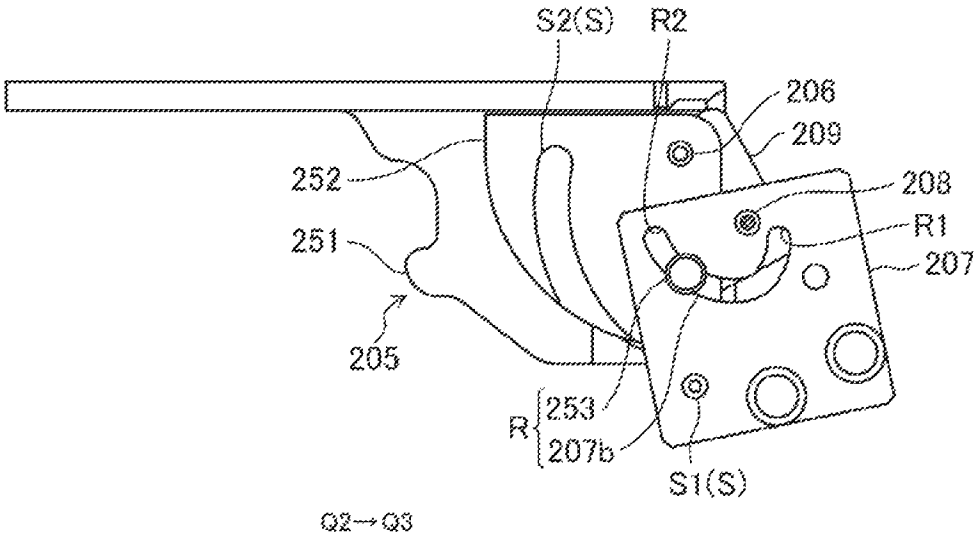

[Fig. 16]
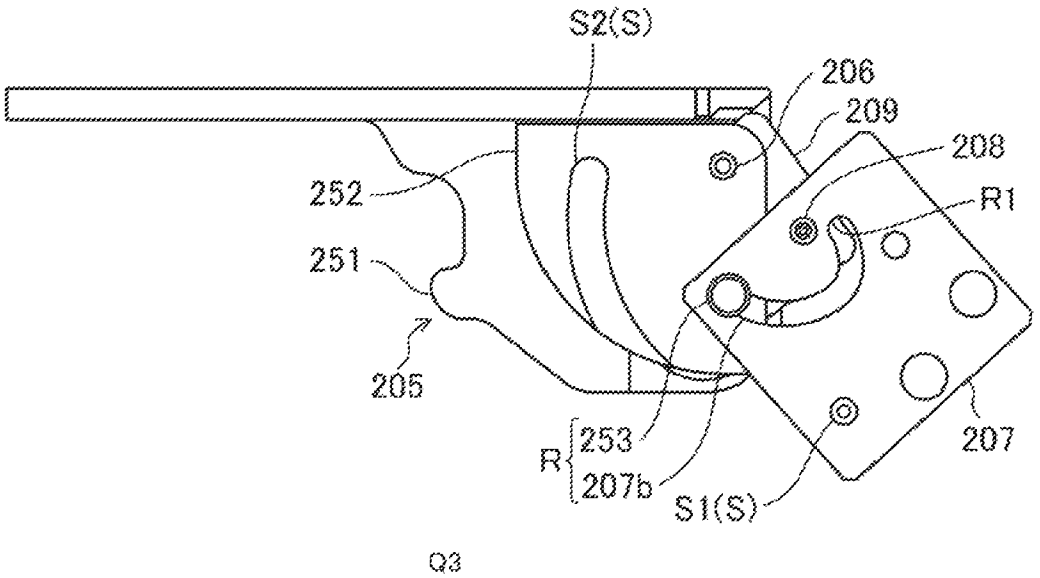

[Fig. 17]
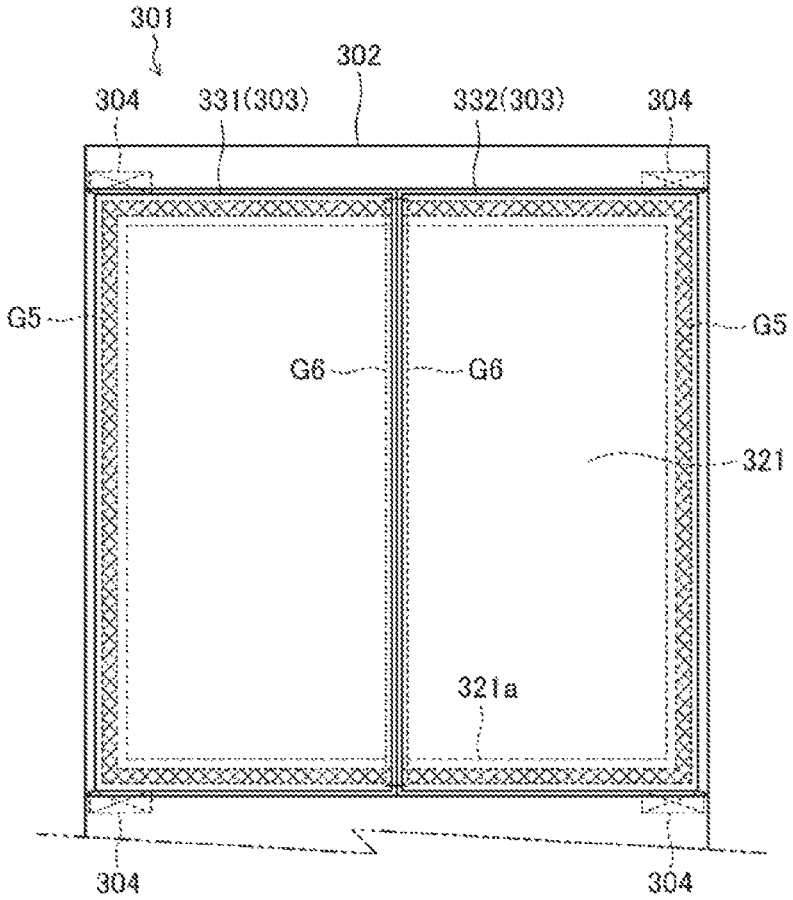

[Fig. 18]
(a)
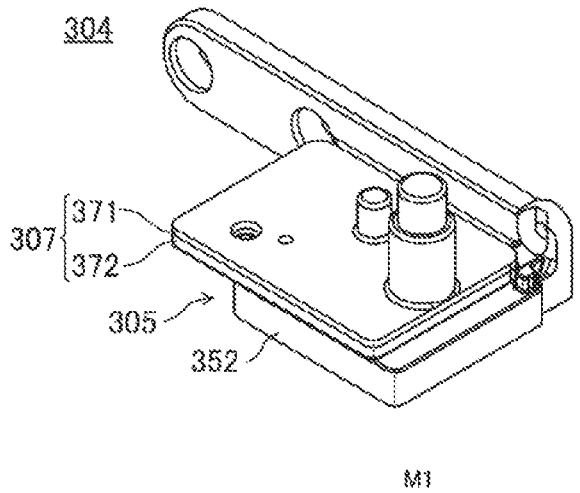
(b)
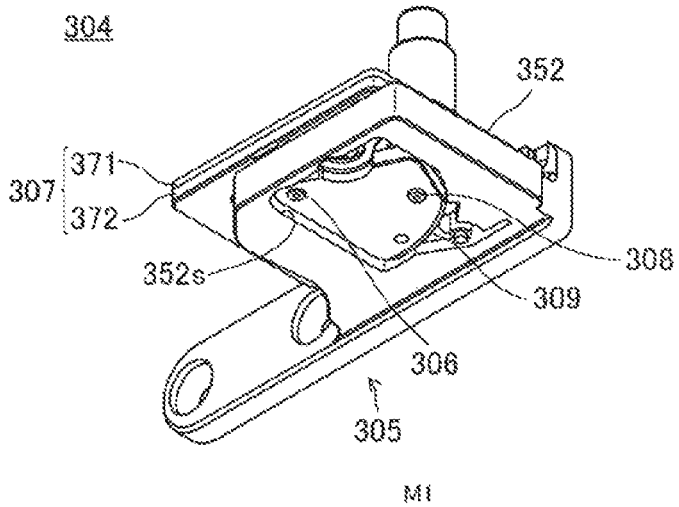

[Fig. 19]
(a)
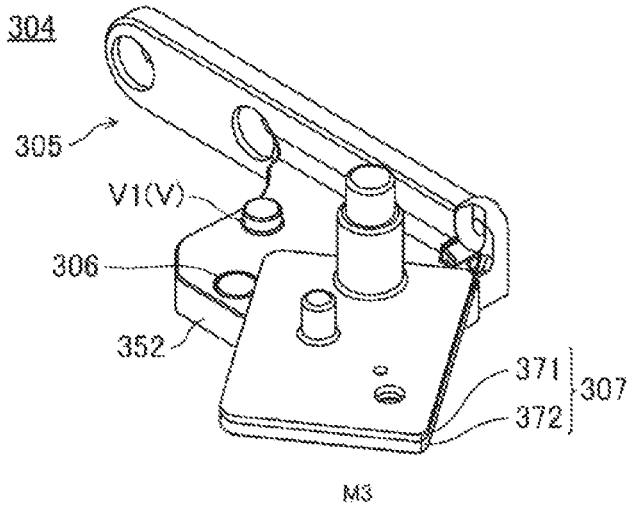
(b)
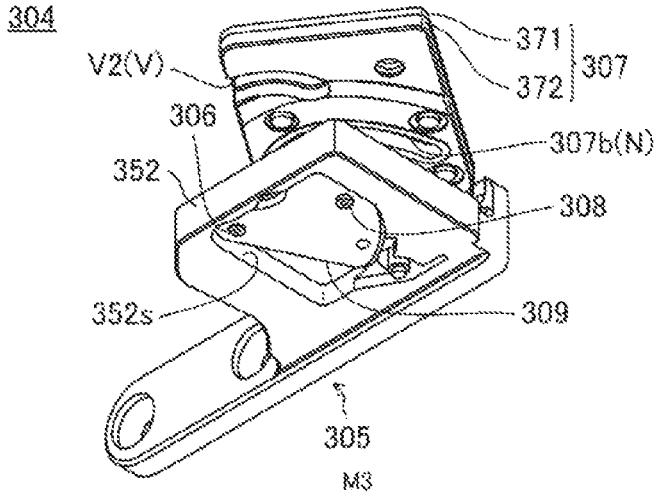

[Fig. 20]
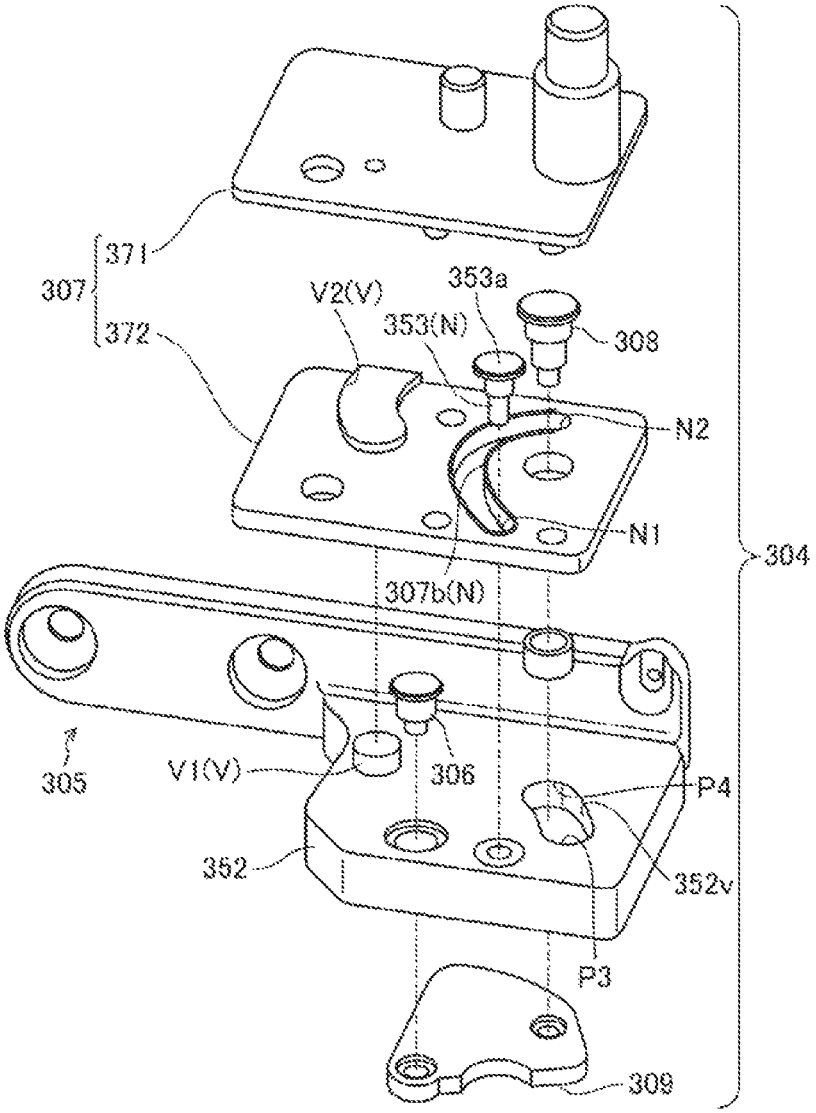

[Fig. 21]
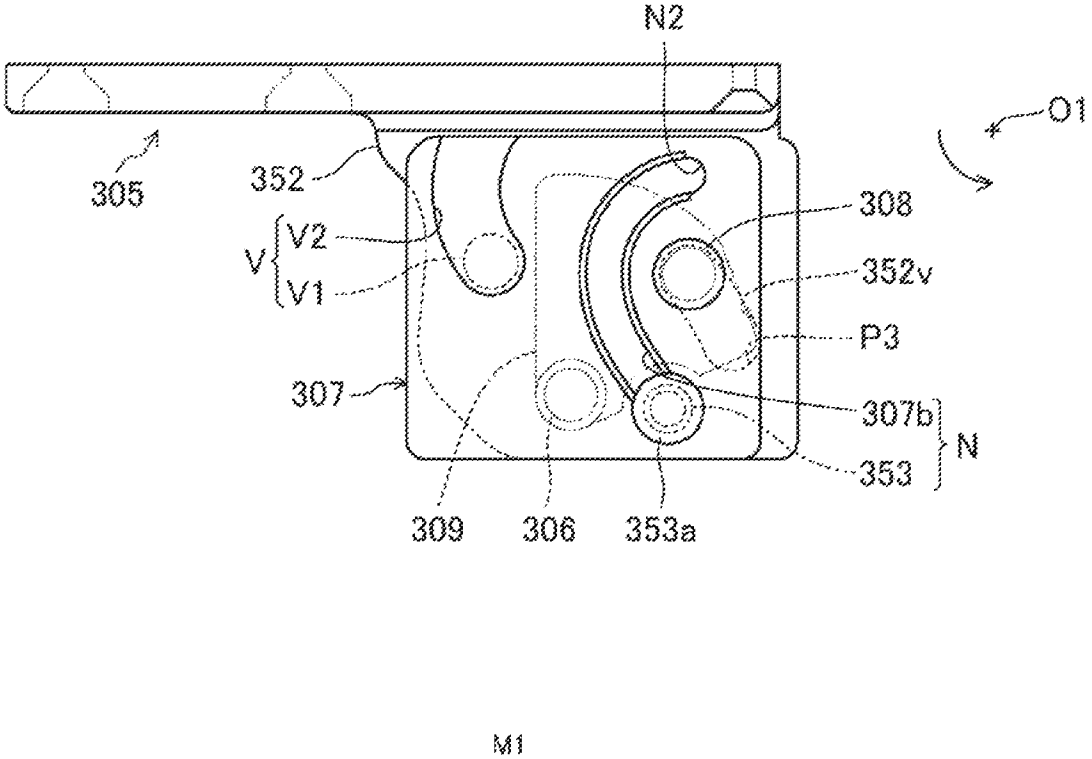

[Fig. 22]
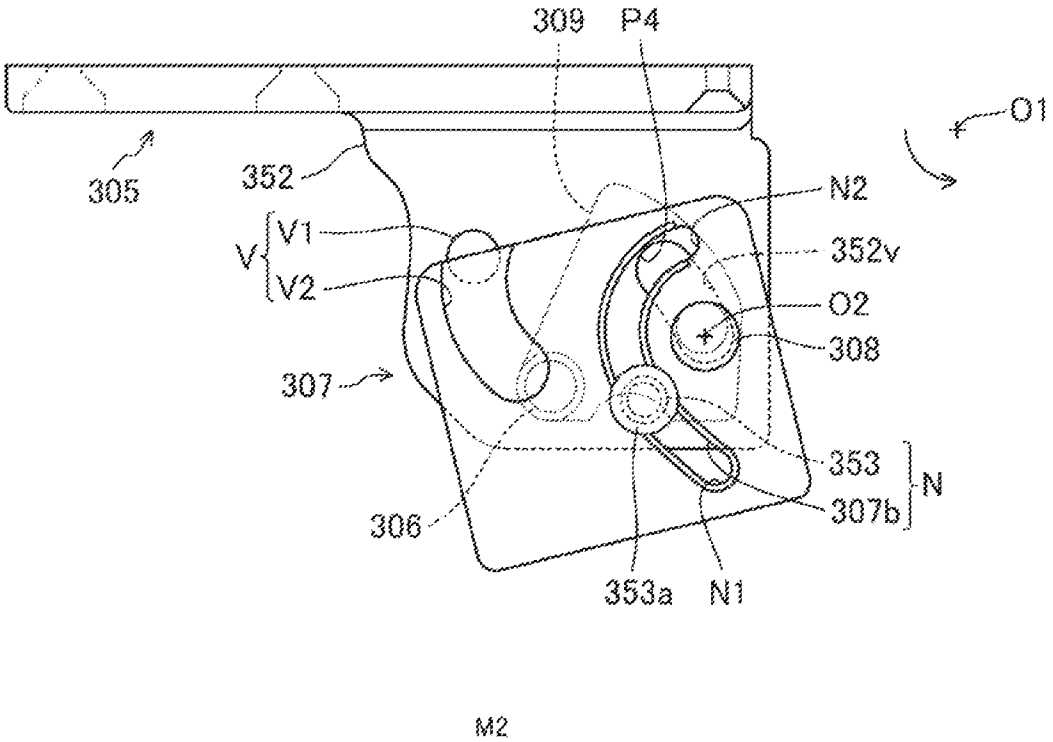

[Fig. 23]
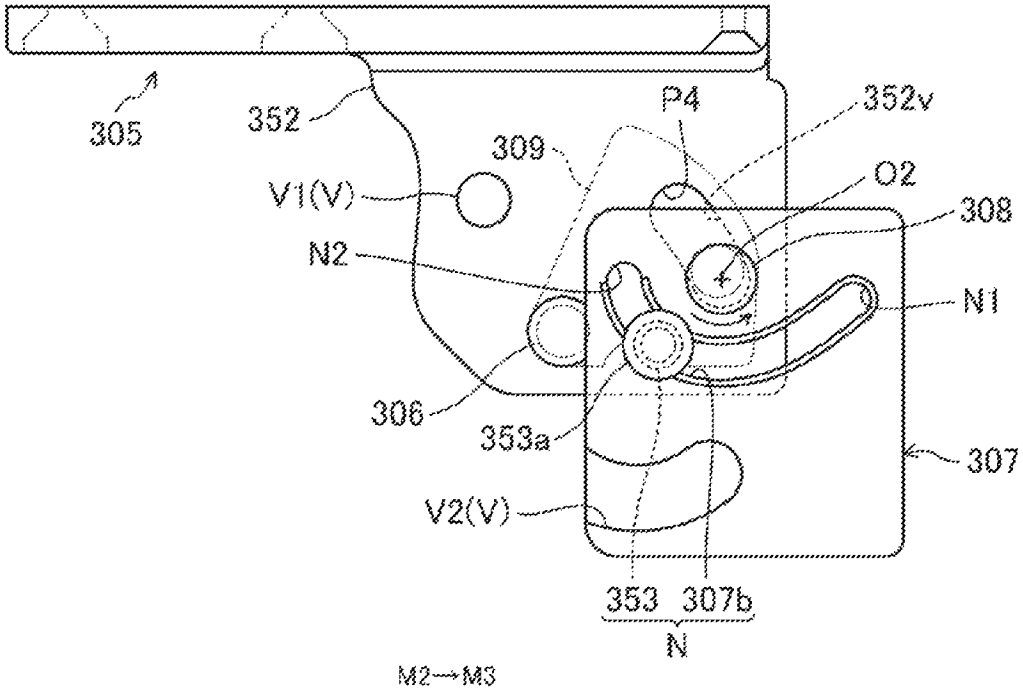

[Fig. 24]
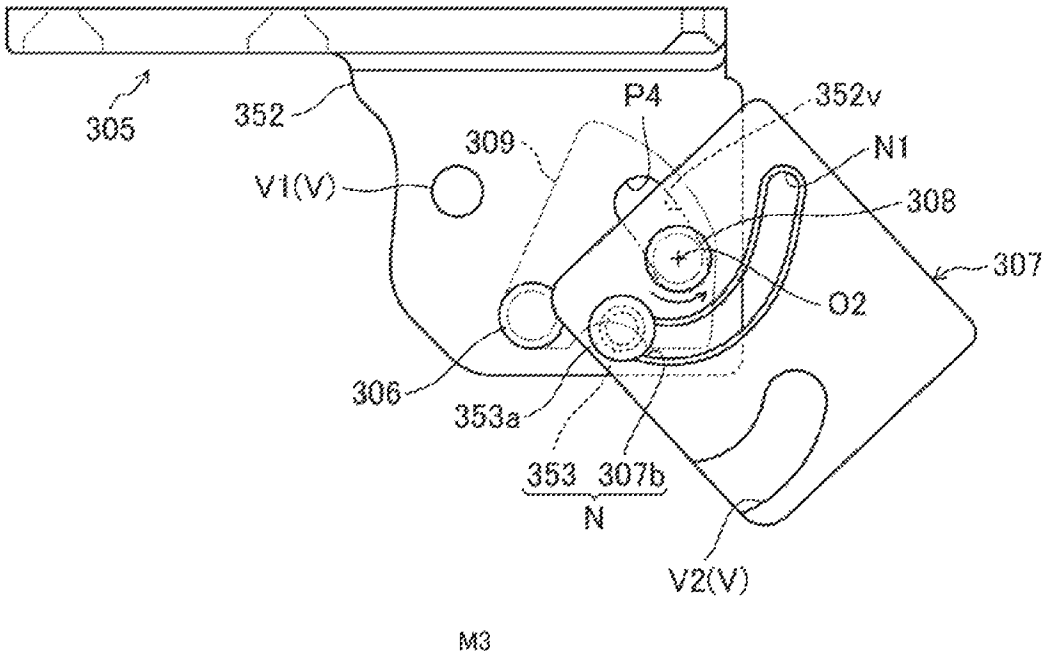

[Fig. 25]
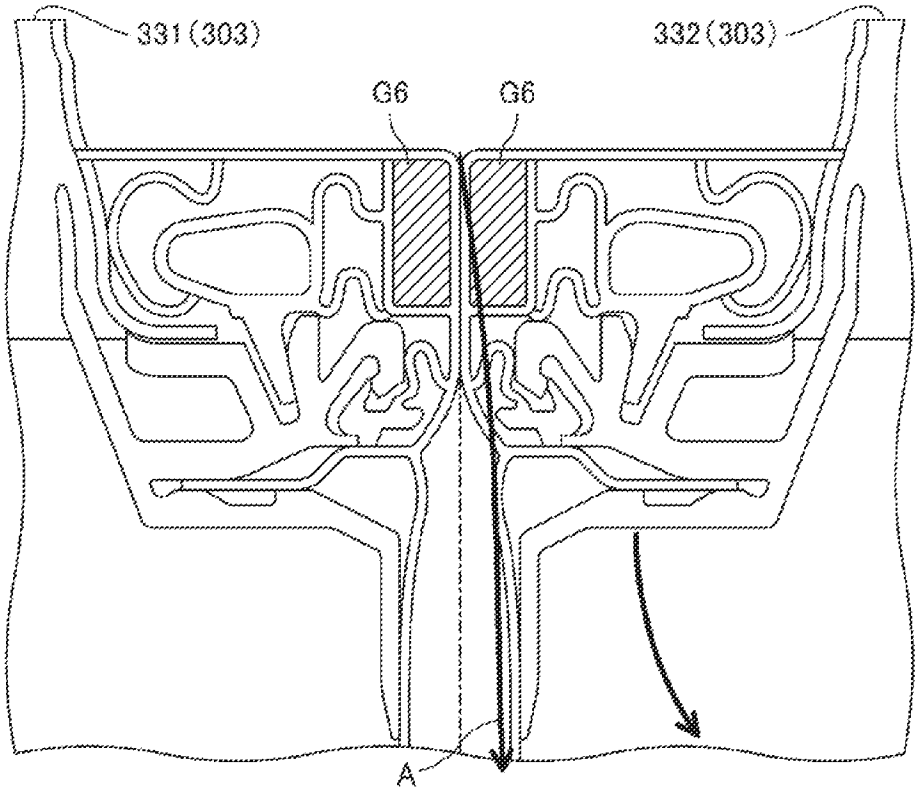

REFRIGERATOR

CROSS-REFERENCE TO RELATED APPLICATIONS

This application is a U.S. National Stage Application, which claims the benefit under 35 U.S.C. §371 of PCT International Patent Application No. PCT/KR2014/009800, filed Oct. 17, 2014, which claims the foreign priority benefit under 35 U.S.C. §119 of Japanese Patent Application No. 2013-216501, filed Oct. 17, 2013, Japanese Patent Application No. 2013-258967, filed Dec. 16, 2013, Japanese Patent Application No. 2014-166133, filed Aug. 18, 2014, and Korean Patent Application No. 10-2014-0140625, filed Oct. 17, 2014, the contents of which are incorporated herein by reference.

TECHNICAL FIELD

The present invention relates to a refrigerator having a storage compartment, and more particularly, to a hinge device provided in a refrigerator.

BACKGROUND ART

A cooling storage (hereinafter, referred to as a refrigerator) of a high capacity type (for example, 400 liters or more) is a type in which doors are opened or closed left and right. The refrigerator has been provided with a pair of doors installed at both left and right sides with respect to an approximately middle portion of an opening installed at a front of a storage compartment such as a refrigeration compartment formed in the refrigerator main body, and both the left and right doors have been configured to be supported by an upper and a lower hinge devices to be capable of opening and closing.

A structure in which a door slides in conjunction with an opening or closing operation of the door by the hinge device or the rotational center of the door is moved such that a rotational shaft of the door is switched to another relatively positioned rotational shaft has been published.

One example of such a hinge device is described in Japanese Unexamined Patent Application Publication No. 2004-301457. The hinge device described in the document is provided with a main body side member (a hinge plate mounted in a refrigerator main body) including a hinge pin and a door side member (a stopper plate mounted in a door) including a long hole into which the hinge pin is slidably inserted. A guide pin and a cam surface (cam portion) are respectively mounted at the door side member plate and the main body side member. When a door is opened from a closed position or is closed to a closed position, as the guide pin comes into contact with the cam surface, the door (specifically, a rotational center of the door) slides in a direction in which the long hole extends. Since the long hole provided in the door side member extends forward or toward the outside when the door is positioned at the closed position, the hinge pin and furthermore the door may slide in the direction in which the long hole extends. For example, as each hinge pin of the doors slides toward the outside in conjunction with opening the doors, a gasket mounted on a side surface of an arc side of one door is separated from a gasket mounted on a facing side surface of the other side door, or as the hinge pins slide forward in conjunction with openings the doors, end portions of rotational shaft sides of doors are separated from each portion of a refrigerator main body.

In addition, a door side member related to the Japanese Unexamined Patent Application Publication No. 2004-301457 is additionally provided with a lip portion which is engaged with a refrigerator main body to maintain a door at a closed position and simultaneously serves as a part of a cam unit when the door is opened from a closed position. That is, the door is opened from the closed position, the hinge device is configured to guide the sliding of the door by a long hole, a guide pin, and the lip portion coming into contact with each other.

Another example of a hinge device is described in Japanese Unexamined Patent Application Publication No. 2002-250171. The hinge device is provided with a main body side member (a peripheral side base), an intermediate member (an intermediate plate), and a door side member (a door side plate), and is disposed in a state in which side surfaces of members thereof are completely overlapped with a surface of the door when the door is positioned at a closed position. The main body side member and the intermediate member are connected to each other pivoted by a first rotational shaft, the intermediate member and the door side member are connected to each other pivoted by a second rotational shaft, and a guide groove which guides movements of the intermediate member and the door side member with respect to the main body side member and a contact portion are installed. When the door is opened, the guide groove and the contact portion guides movements of members such that the intermediate member and the door side member rotate about the first rotational shaft to a predetermined angle in a state in which the intermediate member and the door side member are overlapped, and only the door side member rotates about the second rotational shaft. In such a structure, rotational shafts of doors may be switched in conjunction with an opening or closing operation of the doors according to relative positions of the first rotational shaft and the second rotational shaft.

DISCLOSURE

Technical Problem

However, the hinge device in Japanese Unexamined Patent Application Publication No. 2004-301457 has a problem in that contact portions of the guide pin and the cam surface are separated from each other while the door is opening or closing, and the opening and closing operations of the door are unstable. That is, since sliding contacts of the guide pin and the cam surface are separated from each other, the hinge pin freely slides along the long hole, and the door rattles with respect to the refrigerator main body based on a force of a user applied to the door is added or released. Such a rattling may not only degrade a user's operational sensation of opening or closing a door but also causes an error in the timing for which the door slides with respect to the refrigerator main body or the timing and the like for which the gasket mounted on the door moves when the door is opened. Thus, due to the error, an interference between the door and the refrigerator main body may occur, or the interference between the gasket of the door and the refrigerator main body or the other gasket mounted on the door of the other side thereof may occur.

Meanwhile, in the hinge device described in Japanese Unexamined Patent Application Publication No. 2002-250171, when the door is opened to a predetermined angle or more, the guiding of the opening or closing operation by the guide groove or the contact portion is also degraded. Accordingly, the door freely pivots around the second rotational shaft with respect to the intermediate member, however, since every intermediate members also freely pivots about the first rotational shaft, the opening or closing operation is unstable and a gap thereof may occur. In addition, in the structure of the document, when the door is opened to a predetermined angle or more, the door side member may be separated from the main body side member. Specifically, when the door is opened to the predetermined angle or more, since the main body side member and the door side member do not have an overlapping portion when the hinge device is seen from a direction in which the first or second rotational shaft extends, the door side member is supported by only the intermediate member. In this state, since all load of the door side member is loaded to the intermediate member formed in a plane shape, in terms of mechanical strength, the hinge device is not suitable for a structure in which a pocket for accommodating an object to be accommodated is provided at a rear side of the door such as a refrigerator.

The present invention is invented in consideration of the above-described aspect. The present invention is directed to providing a hinge device for a door which opens or closes an opening of a storage such as a refrigerator and, more particularly, to a hinge device capable of opening or closing a door without a problem of rattling and the like while a rotational center of the door is moving in conjunction with an opening or closing operation of the door.

Technical Solution

One aspect of the present invention provides a refrigerator including a refrigerator main body provided with a storage compartment including an opening, a door which opens or closes the storage compartment, and a hinge device provided between the opening and the door, wherein the hinge device includes a main body side member mounted on the refrigerator main body and provided with a sliding portion, a door side member mounted on the door and provided with a slid portion come into contact with the sliding portion to be respectively movable with respect to the sliding portion, and an intermediate member installed at one direction of the main body side member or the door side member and come into contact with the other direction of the main body side member or the door side member, and when an opening or closing operation of the door, contact between the sliding portion and the slid portion and contact between the main body side member and the door side member through the intermediate member are in conjunction with each other, and a rotational center of the door with respect to the refrigerator main body moves along a predetermined track with respect to the refrigerator main body.

The contact between the sliding portion and the slid portion and the contact between the door side member and the main body side member through the intermediate member may be normally maintained at least any case when the door is positioned at a closed position at which the opening is closed, at a position between the closed and a open positions, and at the open position at which the opening is opened.

The main body side member, the intermediate member and the door side member may include an overlapping region in a widthwise direction of a rotational shaft of the door at least any case when the door is positioned at the closed position, the position between the closed and open positions, and the open position.

The hinge device may further include a cam follower which is installed at one direction of the door side member or the main body side member, and is normally in contact with the cam when the door is positioned at the closed position, the position between the closed and open positions, and the open position, wherein the intermediate member may be provided with the cam, the sliding portion may be provided with a slide pin, the slid portion may be provided with a long hole and the slide pin may be inserted thereinto, and the cam and the cam follower may move the slide pin from one end portion of the long hole to the other end portion in conjunction with the opening or closing operation of the door.

The cam may be provided with first and second cam portions installed at a circumferential side of the slide pin, the cam follower may be provided with first and second follower portions respectively in contact with the first and second cam portions, and the hinge device may be provided to normally maintain a contact portion where the first follower portion is in contact with the first cam portion, a contact portion where an inner circumferential surface of the long hole is in contact with an outer circumferential surface of the slide pin, and a contact portion where the second follower portion is in contact with the second cam portion when the door is positioned at the closed position, the open position, and the position between the closed and the open positions.

The first cam portion may include a first positioning surface which comes in contact with the first follower portion to maintain the door to be positioned at the closed position, a first cam surface which comes into contact with the first follower portion to move the slide pin from the one end portion of the long hole to the other end portion, and a first guide surface having an arc shape centralized by the slide pin positioned at the other end portion of the long hole, the first follower portion may be provided to sequentially move in a state in which the first follower portion comes into contact with the first positioning surface, the first cam surface, and the first guide surface when the door is opened from the closed position, the second cam portion may include a second positioning surface which comes into contact with the second follower portion to maintain the door to be positioned at the closed position, a second cam surface which comes into contact with the second follower portion to move the slide pin from the one end portion of the long hole to the other end portion, and a second guide surface having an arc shape centralized by the slide pin positioned at the other end portion of the long hole, and the second follower portion may provided to sequentially move in a state in which the second follower portion comes into contact with the first positioning surface, the second cam surface, and the second guide surface when the door is opened from the closed position.

The door side member may include a stopper portion which comes into contact with the main body side member to maintain the door to be positioned at the open position, wherein the cam may be provided to move the slide pin from the one end portion of the long hole to the other end portion and a distance between a contact portion where the stopper portion comes into contact with the main body side member and the slide pin when the door is opened from the closed position is greater than a distance between a contact portion where the stopper portion comes into contact with the main body side member and the slide pin when the door is positioned at the closed position.

The intermediate member may be provided as a link member which is supported by the main body side member to be pivotable about a fixed pin provided on the main body side member and is supported by the door side member to be pivotable about a swing pin provided on the door side member, wherein the sliding portion and the slid portion may be provided as a slide unit which guides a track of the door side member with respect to the main body side member.

The swing pin may be provided between the fixed pin and a side surface portion of the refrigerator main body.

When the door is opened from the closed position at which the opening is closed, the slide unit may guide both of the door side member and the link member to rotate about the fixing pin as a main rotational shaft with respect to the main body side member in a range between the closed position and a middle position where the door rotates a predetermined angle from the closed position, and may guide the door side member to rotate about the swing pin as a main rotational shaft with respect to the link member in a range between the middle position and an open position where the door opens the opening.

The slide unit may include a slide pin mounted on the main body side member, and a slide hole installed in the door side member, into which the slide pin is inserted and movably provided, and the slide hole may be provided to have a curvature at a range in which the door moves from the closed position to the middle position is less than a curvature at a range in which the door moves from the middle position to the open position.

The main body side member may include a swing pin guide hole provided with a long hole which guides rotation of the link member about the fixed pin, wherein the swing pin is inserted into the long hole, and the slide unit may guide the swing pin hole to move from one end portion of the swing guide to the other end portion in conjunction with the link member which rotates about the fixed pin in a rotational direction opposite a rotational direction of the door with respect to the main body side member in a range from the closed position at which the door closes the opening to a middle position at which the door rotates a predetermined angle from the closed position, and may guide the door side member to rotate around the swing pin which moved to the other end portion in a range in which the door moves from the middle position to the open position at which the opening is opened.

The slide unit may include a slide pin mounted on the main body side member, a slide hole installed in the door side member wherein the slide pin is movably inserted into the slide hole, wherein the slide hole may be provided to curve toward an inner side based on a widthwise direction of the refrigerator main body at the closed position, and a shape of the slide hole may be provided in an arc shape having a rotational center positioned at an outer side of the refrigerator main body than the swing pin in a range in which the door moves from the closed position to the middle position, and is provided in an arc shape wherein the swing pin is a rotational center of the arc in a range in which the door moves from the middle position to the open position.

The refrigerator may further include a sub-slide unit which is installed between the main body side member and the door side member and is provided at an outside in a diameter direction of the slide unit with respect to the swing pin.

Another aspect of the present invention provides a refrigerator which comprises a hinge device provided between a refrigerator main body provided with a storage compartment including an opening, and a door which opens or closes the storage compartment, wherein the hinge device includes a main body side member mounted on the refrigerator main body, a door side member mounted on the door, and an intermediate member which is installed at one direction of the main body side member or the door side member and comes into contact with the other direction of the main body side member or the door side member, a slide pin is mounted at one direction of the main body side member and the door side member, and a long hole is installed at the other direction wherein the slide pin is inserted into the long hole to be relatively pivotable and simultaneously relatively movable, in an opening or closing operation of the door, a state in which at least a part of the main body side member, a part of the door side member, and a part of the intermediate member are overlapped is maintained at a rotational central axis of the door, contact between the slide pin and the long hole and contact between the main body side member and the door side member through the intermediate member are in conjunction with each other, and a rotational center of the door with respect to the refrigerator main body moves according to an extent of an open or close of the door.

The refrigerator may further include a gasket provided on a rear surface of the door to seal a gap between a front surface of the refrigerator main body and a rear surface of the door around the opening when the door closes the opening, and a cam unit including a cam follower installed at one direction of the main body side member or the door side member to be normally in contact with the intermediate member provided in a cam shape and the cam when the door is positioned at a closed position at which the opening is closed, an open position at which the opening is opened, and a position between the closed and the open positions, wherein the cam unit may move the slide pin to one end portion of a long hole and separates the gasket from the front surface of the refrigerator main body when the door is opened from the closed position, and may move the slide pin to the other end portion of the long hole and brings the gasket into contact with the front surface of the refrigerator main body when the door is closed.

The intermediate member may be provided as a link member which is supported by the main body side member to be pivotable about a fixed pin provided on the main body side member, and is supported by the door side member to be pivotable about a swing pin installed in the door side member and provided at a side outer than the fixed pin when the door is positioned at a closed position at which the opening is closed, the slide pin and the long groove may be provided as a slide unit which guides a track of the door side member with respect to the main body side member, and the slide unit may guide the door side member with the intermediate member to rotate about the fixing pin as a main rotational shaft with respect to the main body side member in a range between the closed position and a middle position at which the door rotates a predetermined angle from the closed position, and may guide the door side member to rotate about the swing pin as a main rotational shaft with respect to the intermediate member in a range between the middle position and an open position at which the door opens the opening.

The intermediate member may be provided to be pivotable through a fixing pin of the main body side member, the door side member may be provided to be installed to be pivotable through a swing pin of the intermediate member, the refrigerator may further include a slide unit which is installed between the main body side member and the door side member and guides a track of the door side member with respect to the main body side member, the main body side member may include a swing guide hole in which the swing pin is inserted to be relatively movable with respect to the main body side member, and the swing guide hole may guide the swing pin to move from one end portion of the swing guide hole to the other end portion in conjunction with the link member which rotates about the fixed pin in a rotational direction opposite a rotational direction of the door with respect to the main body side member in a range in which the door moves from a closed position at which the opening is closed to a middle position at which the door rotates a predetermined angle, and may guide the door side member to rotate around the swing pin which moved to the other end portion in a range in which the door moves from the middle position to an open position at which the opening is opened.

Advantageous Effects

A hinge device according to an exemplary embodiment of the present invention supports the door to be movable and pivoted and rotatable with respect to a refrigerator main body and, meanwhile, stabilizes an opening or closing operation of the door to be without rattling since the hinge device guides the track of the door by coming into a contact with the refrigerator main body using an intermediate member.

DESCRIPTION OF DRAWINGS

FIG. 1 is a perspective view schematically illustrating an exterior of a refrigerator according to a first embodiment of the present invention.

FIG. 2A is an exploded perspective view illustrating a hinge device according to the first embodiment of the present invention seen from a front surface side thereof, and FIG. 2B is a perspective view seen from a rear surface side thereof.

FIG. 3 is a perspective view illustrating the hinge device according to the first embodiment of the present invention seen from the front surface side.

FIG. 4 illustrates views of a pivot operation of a bearing member with respect to a shaft member of the hinge device according to the first embodiment of the present invention, and in the figure, FIG. 4A is a plan view illustrating a closed position at which a pivot angle of a bearing member (a door) is 0°, FIG. 4B is a plan view illustrating a position between the closed and an open positions at which the pivot angle of the bearing member (the door) is 15°, FIG. 4C is a plan view illustrating another position the closed and the open positions at which the pivot angle of the bearing member (the door) is 45°, and FIG. 4D is a plan view illustrating an open state at which the pivot angle of the bearing member (the door) is 135°.

FIG. 5 is an enlarged plan view illustrating a cam structure of the hinge device according to the first embodiment of the present invention.

FIG. 6 is an enlarged cross-sectional view schematically illustrating a structure of a peripheral portion of a left end side when the left door is positioned at the closed position according to the first embodiment of the present invention.

FIG. 7 illustrates relative positions among a bearing member, a shaft member, and the cam seen from a rotational shaft of the shaft member when the shaft member of the hinge device pivots with respect to the bearing member according to the first embodiment of the present invention, and corresponds to FIG. 4.

FIG. 8 is a schematic view illustrating a structure of a cooling storage according to a second embodiment of the present invention.

FIG. 9 is a perspective view illustrating a hinge device according to the second embodiment of the present invention at a closed position.

FIG. 10 is a perspective view illustrating the hinge device according to the second embodiment of the present invention at an open position.

FIG. 11 is a schematic view illustrating a structure of the hinge device according to the second embodiment of the present invention.

FIG. 12 is a perspective view illustrating a disassembled hinge device according to the second embodiment of the present invention seen from below.

FIG. 13 is a plan view illustrating the hinge device according to the second embodiment of the present invention at the closed position.

FIG. 14 is a plan view illustrating the hinge device according to the second embodiment of the present invention at a middle position.

FIG. 15 is a plan view illustrating the hinge device according to the second embodiment of the present invention during moving from the middle position to the open position.

FIG. 16 is a plan view illustrating the hinge device according to the second embodiment of the present invention at the open position.

FIG. 17 is a schematic view illustrating a structure of a refrigerator according to a third embodiment of the present invention.

FIG. 18A is a perspective view illustrating a hinge device according to the third embodiment of the present invention at a closed position seen from the above, and FIG. 18B is a perspective view illustrating the hinge device at the same position seen from the below.

FIG. 19A is a perspective view illustrating the hinge device according to the third embodiment of the present invention at an open position seen from the above, and FIG. 19B is a perspective view illustrating the hinge device at the same position seen from the below.

FIG. 20 is an exploded perspective view illustrating when the hinge device is disassembled according to the third embodiment of the present invention.

FIG. 21 is a plan view illustrating the hinge device according to the third embodiment of the present invention at the closed position.

FIG. 22 is a plan view illustrating the hinge device according to the third embodiment of the present invention at a middle position.

FIG. 23 is a plan view illustrating the hinge device according to the third embodiment of the present invention during moving from the middle position to the open position.

FIG. 24 is a plan view illustrating the hinge device according to the third embodiment of the present invention at the open position.

FIG. 25 is a conceptual cross-sectional view illustrating a track of movement of an end portion of an opening side of a gasket provided on a side surface of a door when the door of the refrigerator is opened according to the third embodiment of the present invention.

MODES OF THE INVENTION

Hereinafter, first to third embodiments related to the present invention will be described in detail with reference to the accompanying drawings.

The embodiments described in this specification are merely examples essentially, and do not intend to limit a use or an application.

First Embodiment

A first embodiment described below is illustrated in FIGS. 1 to 7.

FIG. 1 is a view schematically illustrating a refrigerator 101 according to the first embodiment of the present invention. For the sake of convenience in the description, in FIG. 1, a direction from a left corner side of a page toward a right front side is referred to as a lateral direction (a widthwise direction (specifically, a widthwise direction of the refrigerator 101)), a direction from a left front side of the page toward a right corner side is referred to as a forward or backward direction (a forward or backward direction of the refrigerator 101), and a direction of an upper and lower direction of the page is referred to as a vertical direction (a height direction (specifically, a height direction of the refrigerator 101)). In FIGS. 2 to 7, when there are no additional descriptions, directions corresponding thereto are respectively referred to as the lateral direction (the widthwise direction), the forward or backward direction, and the vertical direction (height direction).

As illustrated in FIG. 1, the refrigerator 101 according to the embodiment is vertically formed in an approximately rectangular hexahedral exterior shape to have a vertical length and includes a refrigerator main body 102 for accommodating keeping objects. A first storage compartment 121, a second storage compartment 122, a third storage compartment 123, and a fourth storage compartment 124 having an approximately rectangular hexahedral shape are partitioned by inner wall portions in the refrigerator main body 102. The storage compartments 121 to 124 are respectively communicated with a first opening 121*a*, a second opening (not shown), a third opening (not shown), and a fourth opening (not shown) which are installed at a front surface of the refrigerator main body 102, and opened to be arranged from an upper portion to a lower portion, and have a rectangular shape. For example, a plurality of partition plates (not shown) for partitioning the storage compartment 121 are installed in the first storage compartment 121 (hereinafter, simply referred to as the storage compartment 121), and the keeping objects are placed on the partition plate.

As illustrated in FIG. 1, left and right doors (hereinafter, one side between both of the left and right doors may be simply referred to as a door 103) which are pivotably supported at left and right end portions by upper and lower hinge devices 104 to open or close the first opening 121*a* and be a type where both sides open (left-right open or close type) may be installed at a peripheral of the first opening 121*a* at an uppermost portion among the first to fourth openings.

In addition, an upper end loading door 103*a*, an intermediate loading door 103*b*, and a lower loading door 103*c* are respectively installed at the second to fourth storage compartments 122 to 124, and open or close the openings by sliding forward or backward.

In addition, since all of the upper end loading door 103*a*, the intermediate loading door 103*b*, and the lower loading door 103*c* are configured by known structures, the detail descriptions thereof are omitted. In addition, the number and an arrangement of the opening and the storage compartment communicated therewith are not limited to the above-described structure. There may be at least one opening which is open or closed by a door supported by at least upper and lower hinge devices 104 and may be suitably substituted with elements used for conventional refrigerators and the like.

In the present embodiment, since a shape of the door is in a mirror image symmetry, for example, the left door 103 and the peripheral thereof will be described hereinafter in a state in which the right door 103 is normally closed.

As illustrated in FIG. 1, the door 103 for opening or closing the first opening 121*a* (hereinafter, all openings is simply referred to as the opening 121*a*) has an exterior in a rectangular plate shape partitioned by, for example, a thin resin plate or a thin metallic plate, and a heat insulation member formed by a urethane foam or the like fills the door.

Gaskets G1 having a hollow tube shape are integrally mounted on a rear surface of the door 103 along the peripheral and seals a gap between the front surface of the refrigerator main body 102 around the opening 121*a* and the rear surface of the door 103 when the door 103 closes the opening 121*a*.

The gasket G1 is formed of a soft material having flexibility such as rubber and soft resin. An interlocking protrusion (not shown) for attaching the gasket G1 to the door 103 and a magnet holder (not shown) having a hollow shape into which a magnet G2 having a string shape is inserted and maintained thereinto are integrally mounted on the gasket G1 in the lengthwise direction of the gasket G1.

In addition, an interlocking groove (not shown) with which the interlocking protrusion is interlocked is installed on the rear surface of the door 103 along four sides forming the peripheral thereof. The gasket G1 in which the magnet G2 is inserted into the magnet holder is fixed to the door 103 by the interlocking protrusion being inserted into the interlocking groove of the door 103.

FIG. 6 is a cross-sectional view schematically illustrating a structure of a peripheral portion of a left end side in a closed state (hereinafter, may be described as a closed position) in which the door 103 closes the opening 121*a* of the refrigerator main body 102. As illustrated in the drawing, the magnet G2 is arranged to be maintained at one side surface side of the gasket G1 and to be close to the front surface of the refrigerator main body 102 around the opening 121*a* when the door 103 is in a closed state.

When the door 103 is in a closed state, since a metallic plate (not shown) arranged on the front surface of the refrigerator main body 102 around the opening 121*a* adheres to the magnet G2, the front surface and the gasket G1 are pressed against each other, and the front surface of the refrigerator main body 102 around the opening 121*a* and the rear surface of the door 103 are sealed.

As will be described later, a hinge pin 153 as a type of a sliding portion fixed to the refrigerator main body 102 is inserted into the door 103. When the door 103 is in a closed state, the hinge pin center 153*a* is positioned at a position marked as + in FIG. 6. At this point, a position at which the gasket G1 and the rear surface of the door 103 are pressed against each other by the magnet G2 is positioned at an outer side of the opening 121*a* in the lengthwise direction (hereinafter, simply referred to as an outside) compared to a position of the hinge pin center 153*a*.

In addition, shapes of the gasket G1, the magnet G2, and the magnet holder, and the mounting structure and position of the gasket G1 are not limited to the above-described structure, but structures which are used for conventional refrigerators and the like may be suitably used. A door pocket forming portion T which is positioned at an inner side of the opening 121*a* in a widthwise direction (hereinafter, simply referred to as an inner side) compared to the gasket G1 is inserted into the storage compartment 121 from the opening 121*a* in a state in which the door 103 is in a closed state and has a rectangular frame shape is integrally installed in the rear surface of the door 103. The door pocket forming portion T is a linear protrusion perpendicular to the rear surface of the door 103 and includes four throat portions T1 having four sides. A facing surface 103*d* which extends in parallel along the rear surface of the door 103 is formed between a throat portion T1 (hereinafter, simply referred to as the throat portion T1) which extends in parallel along a rotational axis of the door 103 among the throat portions T1 and positioned at the rotational axis side and a gasket G1 (hereinafter, simply referred to as a gasket G1) which is positioned at an outside of the throat portion T1.

When the door 103 is in a closed state, the facing surface 103*d* faces and comes into contact with the front surface of the refrigerator main body 102 around the opening 121*a* and simultaneously a throat side surface portion T2 facing an outside of the door 103 among outer walls of the throat portion T1 in a widthwise direction faces and comes into contact with a wall surface in the storage compartment 121. Thus, a gap between an inner portion of the storage compartment 121 and the gasket G1 are sealed by the contacts.

The left door 103 configured as such is supported at a left end portion of the refrigerator main body 102 by the upper and lower hinge devices 104. Hereinafter, although a lower hinge device 104 which supports a left end side lower portion of the left door 103 is exemplified and described, an upper hinge device 104 has also almost the same structure. Below, only when there are structural differences related to technical specifications of the present invention between the upper hinge device 104 and the lower hinge device 104, the structures will be described, and the other structures are the same. Upper and lower hinge devices 104 which support the right door 103 are also the same as described above.

FIG. 3 is a perspective view illustrating a structure of the lower hinge device 104 (hereinafter, simply referred to as the hinge device 104) according to the embodiment of the present invention, and FIGS. 2A and 2B are exploded perspective views illustrating the hinge device 104 respectively seen from the front and the rear. For the sake of convenience in the description, in FIGS. 2A and 3, a direction from a left front side of pages toward a right corner side is referred to as a lateral direction (a widthwise direction), a direction from a right front side of the pages toward a left corner side is referred to as a forward or backward direction, and a vertical direction of the pages is referred to as a vertical direction (a height direction). In FIG. 2B, directions corresponding thereto are respectively referred to as the lateral direction (the widthwise direction), the forward or backward direction, and the upper and lower direction (height direction). That is, in FIG. 2B, a direction from a right front side of the page toward a left corner side is referred to as the lateral direction (the widthwise direction), and a direction from a right corner side of the page toward a left front side is referred to as a forward or backward direction.

As illustrated in FIG. 3, the hinge device 104 according to the embodiment of the present invention includes a shaft member 105 as a main body side member fixed to the refrigerator main body 102 and a bearing member 107 as a door side member fixed to the door 103.

The shaft member 105 is configured including a hinge plate 151 and a hinge pin 153 as a sliding portion. Meanwhile, a long hole 107*b* as a slid portion into which the hinge pin 153 is inserted to be relatively movable and contactable is installed in the bearing member 107

As illustrated in FIG. 2, the shaft member 105 further includes a layer having a structure described below and includes a cam 109 as an intermediate member. A cam follower 107*d* which comes into contact with the cam 109 is installed in the bearing member 107.

Specifically, As illustrated in FIGS. 2A and 2B, the hinge plate 151 includes an attachment plate 151*b* having approximately a rectangular shape whose long side thinly and lengthily extends in a lateral direction and short side extends in a vertical direction and a hinge plate main body 151*a* having approximately a rectangular shape which is integrally formed with the attachment plate 151*b* and whose long side extends from a left end side of the attachment plate 151*b* toward a right side and short side extends surface-perpendicular to the attachment plate 151*b* from a front surface of a left end side of the attachment plate 151*b* toward a front side.

Hinge plate attachment holes 151*d*, 151*d*, and 151*d* are punched in three positions, that is, both end portions and a central portion in the attachment plate 151*b*. In addition, screw holes (not shown) punched in a lower portion of a left end side of the front surface of the refrigerator main body 102 around the opening 121*a* are fastened by bolts and the like through the hinge plate attachment holes 151*d*, 151*d*, and 151*d*, and the hinge plate 151 is integrally mounted on the refrigerator main body 102. The hinge plate 151 in the refrigerator main body 102 is positioned so that when the hinge pin 153 is fixed to the hinge plate 151, the hinge pin 153 vertically protrudes upward (when the upper hinge device 104 is attached thereto, the upper hinge pin 153 vertically protrudes downward). In addition, An arrangement, the number, and the like of the hinge plate attachment hole 151*d*, the installation method of the attachment plate 151*b* at the refrigerator main body 102, a shape of the attachment plate 151*b*, and the like are not limited the above-described structure.

In addition, a hinge pin fixing portion 151*c* whose cross-section has, for example, a shape of a circular segment is integrally formed on an upper surface of a left front side of the hinge plate main body 151*a* to vertically protrude upward (see FIG. 2A).

A stopper support 151*e* formed in a concave shape in a vertical direction is formed in a side portion of a left side of the hinge plate main body 151*a*, and meanwhile, a lip support 151*f* formed in a concave shape in a vertical direction is formed on a side portion of a right side of the hinge plate main body 151*a*. In addition, the stopper support 151*e* and the lip support 151*f* are not absolutely needed to be formed, and shapes thereof are not limited to the above-described structure.

The hinge pin 153 is formed as an approximately cylindrical partial hollow member, and the cam 109 as a member having a step portion in a flange shape toward the outside is integrally mounted on a lower end portion of the hinge pin 153.

FIG. 5 is an enlarged plan view illustrating an exterior of the cam 109. As illustrated, the cam 109 is installed to extend around the hinge pin 153, and has an asymmetric shape in a direction in which the hinge pin center 153*a* extends. The clockwise rotation direction in the embodiment corresponds to a direction which rotates from an upper portion of a page of FIG. 5 through a right side of the page (an arrow direction of X axis of FIG. 4) toward a lower portion of the page (an arrow direction of Y axis in FIG. 4).

In addition, the cam 109 is partitioned into a first cam portion 191 and a second cam portion 192 to partition an outer circumferential portion of the step portion into two portions and is formed so that one end portion of the first cam portion 191 and one end portion of the second cam portion 192 are connected to each other and the other end portion of the first cam portion 191 and the other end portion of the second cam portion 192 are connected to each other.

The first cam portion 191 of the cam 109 is partitioned into a region from approximately six o'clock direction to a twelve o'clock direction in the clockwise rotation direction in the page of FIG. 4 when seen from the hinge pin center 153*a*, and meanwhile, the second cam portion 192 is partitioned into a region from the twelve o'clock direction to approximately the six o'clock direction in the same direction.

In addition, the first cam portion 191 and the second cam portion 192 are respectively partitioned into a first positioning surface 191*a*, a first cam surface 191*b*, a first guide surface 191*c*, and a first rotation stop surface 191*d* and a second positioning surface 192*a*, a second cam surface 192*b*, a second guide surface 192*c*, and a second rotation stop surface 192*d*.

Specifically, the first cam portion 191 includes the first positioning surface 191*a* having a plane surface, the first cam surface 191*b* which is formed to extend from one end portion of the first positioning surface 191*a* along approximately an arc in the clockwise rotation direction and serves as a leading end of a cam, the first guide surface 191*c* which is formed to extend from one end portion of the first cam surface 191*b* along an arc of 90° in the clockwise rotation direction when seen from the hinge pin center 153*a* and serves as a cam base having the hinge pin center 153*a* as the center, and the first rotation stop surface 191*d* which is formed to extend from one end portion of the first guide surface 191*c* in the clockwise rotation direction and extend to be a tangential plane to the first guide surface 191*c*. In comparison with this, the second cam portion 192 includes the second positioning surface 192*a* which is formed to extend from one end portion of the first rotation stop surface 191*d* in the clockwise rotation direction and vertically extends in a concave shape, and the second cam surface 192*b* which is formed to extend from one end portion of the second positioning surface 192*a* in the clockwise rotation direction so that a thicker portion of the hinge pin center 153*a* gradually becomes thin, the second guide surface 192*c* which is formed to extend from one end portion of the second cam surface 192*b* in the clockwise rotation direction to have an arc of 90° when seen from the hinge pin center 153*a* and serves as the cam base having a diameter less than the first guide surface 191*c* centralized by the hinge pin center 153*a*, and the second rotation stop surface 192*d* which is formed to extend from one end portion of the second guide surface 192*c* in the clockwise rotation direction and simultaneously connected to an end portion of the first positioning surface 191*a*, and meanwhile, having a concave shape which vertically extends.

In addition, the hinge pin 153 is formed to have a hollow structure having a central hole which is fit to an exterior of the hinge pin fixing portion 151*c* and have a shape of a circular segment (see FIG. 2B). Since a cross-sectional shape of the hinge pin fixing portion 151*c* and a cross-sectional shape of the central hole of the hinge pin 153 each has a shape of a circular segment, the cross-sectional shapes serve to position which guides an arrangement of the hinge pin 153 when the hinge pin 153 is fixed and simultaneously also as a rotation stop which prevents the hinge pin 153 from gliding over the hinge pin fixing portion 151*c*. The circular segment portions are arranged such that the first positioning surface 191*a* of the cam 109 faces a front side of the refrigerator main body 102 when the hinge plate 151 in which the hinge pin 153 is mounted, that is, the shaft member 105 is fixed to the refrigerator main body 102 by the hinge pin fixing portion 151*c*. In addition, a cross sectional shape of the hinge pin fixing portion 151*c* and a cross sectional shape of a central hole of the hinge pin 153 are not limited to the above-described shapes, but may be suitably changed As the hinge pin 153 is inserted into the hinge pin fixing portion 151*c* to be fitted to an exterior of the hinge pin 153 and a bottom surface portion of the hinge pin 153 comes into contact with a top surface of the hinge plate main body 151*a* around the hinge pin fixing portion 151*c*, the hinge plate 151 and the hinge pin 153 become the integrated shaft member 105.

The shaft member 105 is configured as above-described. Meanwhile, the bearing member 107 which constitutes the hinge device 104 with the shaft member 105 includes a bearing plate portion 107*a* which extends along the horizontal surface and has a rectangular thin plate shape, as illustrated in FIGS. 2A and 2B, bearing plate installation portions 107*c* which are punched at a right end side of a longer side of the bearing plate portion 107*a* and are arranged at two positions of a shorter side, a long hole 107*b* which is formed in a central portion of a left end side of the bearing plate portion 107*a* and punched in a long hole shape which connects both ends of two parallel lines extending along a shorter side to be a semicircle.

A screw hole (not shown) is provided in a bottom surface of a left end side of the door 103, and by fastening bolt or the like to the screw hole of the door 103 through the bearing plate installation portion 107*c*, the bearing member 107 is integrally mounted on the door 103. The bearing member 107 and the door 103 are positioned so that a longer side of the bearing member 107 is parallel to a widthwise direction of the door 103 in a state in which one side of the bearing member 107 having the bearing plate installation portion 107*c* faces a central portion in a widthwise direction of the door 103. Accordingly, in a state in which the bearing member 107 is attached to the door 103, when the door 103 is in a closed state, the long hole 107*b* of the bearing plate portion 107*a* is configured to extend in a forward or backward direction of the door 103. (Positioning in a posture in which the long hole 107*b* of the bearing plate portion 107*a* extends in the forward or backward direction of the door 103 when the door 103 is in a closed state). In addition, an arrangement and a shape of the bearing plate installation portion 107*c* and a method of installation and the like of the bearing plate portion 107*a* is not limited thereto.

In addition, a long hole (not shown) which communicates with the long hole 107*b* when the bearing member 107 is attached to the door 103 is provided in a bottom surface of the left end side of the door 103.

In addition, the long hole 107*b* is provided such that an inner circumferential surface of a semicircular portion of both ends thereof is in contact with an outer circumferential surface of the hinge pin 153. Accordingly, the hinge pin 153 is relatively pivotable and inserted into the long hole 107*b*, and the hinge pin 153 may not move toward a shorter side of the long hole 107*b* in a state in which the hinge pin 153 is inserted into the long hole 107*b*. In addition, in the above-described state, the hinge pin 153 is configured to be relatively movable between both end portions of the long hole 107*b*.

As the hinge pin 153 of the shaft member 105 is inserted into the long hole 107*b* of the bearing member 107 and a bottom surface of the bearing plate portion 107*a* comes into contact with a top surface of the step portion of the hinge pin 153 (that is a top surface of the cam 109), the hinge device 104 which supports the door 103 such that the door 103 is capable of pivoting and movable with respect to the refrigerator main body 102 is provided.

In addition, in a state in which a first end portion P1 (see FIG. 4A) positioned at a front side of a longer side of the long hole 107*b* (a front surface side of the door 103) and the hinge pin 153 come into contact with each other, when the door 103 and the refrigerator main body 102 are close to each other to close the door 103, the long hole 107*b* is configured such that the gasket G1 and the front surface of the refrigerator main body 102 around the opening 121*a* are pressed against each other. In addition, in a state in which a second end portion P2 (see FIG. 4A) positioned at a front side of the longer side of the long hole 107*b* (a rear surface side of the door 103) and the hinge pin 153 come into contact with each other, when the door 103 and the refrigerator main body 102 are separated from each other and the door 103 pivots, the long hole 107*b* is configured such that the gasket G1 and the front surface of the refrigerator main body 102 around the opening 121*a* do not interfere with each other.

In addition, a first follower portion 107*e* in a rectangular thin plate shape is formed at one direction close to the first end portion P1 of the long hole 107*b* among peripheral portions of a side extending along the longer side of the bearing plate portion 107*a* by vertically bending downward the peripheral portion of the side.

In addition, a second follower portion 107*f* (see FIG. 2B) which protrudes downward from a bottom surface of the bearing plate portion 107*a* and has approximately a cylindrical shape is formed between the other direction close to the second end portion P2 of the long hole 107*b* in the peripheral portions of the side extending along the longer side of the bearing plate portion 107*a* and the second end portion P2.

The first and second follower portions 107*e* and 107*f* are arranged to serve as a pair of cam followers 107*d* which are normally in contact with the first and second cam portions 191 and 192, and a cam unit C formed with the cam 109 installed on the hinge pin 153 normally guides an operation of the bearing member 107 with respect to the shaft member 105, that is, a movement and pivot of the door 103 with respect to the refrigerator main body 102, using the cam follower 107*d*.

FIGS. 4A to 4D are views illustrating an operation of the cam unit C when the bearing member 107 pivots with respect to the shaft member 105. FIG. 4A is a view when the door 103 is in a closed state (a pivot angle of the bearing member 107 and the door 103 is 0°), FIGS. 4B and 4C are views when the door 103 is in a state in which the door is opening or closing (hereinafter, may also be referred to as a position in which the door is opening or closing, and pivot angles of the bearing member 107 and the door 103 are respectively 15 and 45°), and FIG. 4D is a view when the door 103 is in an open state (hereinafter, may also be referred to as an open position, a pivot angle of the bearing member and the door 103 is 135°. Since the door 103 and the bearing member 107 pivot together, the bearing member 107 and the door 103 may be interchangeably understood in a suitable manner. In addition, the pivot angle is an angle formed when the bearing member 107 and the door 103 pivot from an X axis toward Y axis (the rotational direction is referred to as a clockwise rotation direction similar to the description in FIG. 5). In addition, in FIG. 4, the bearing plate portion 107*a* which constitutes the bearing member 107 is omitted.

As illustrated in FIG. 4A, when the door 103 is in a closed state, the hinge pin 153 comes into contact with the first end portion P1 of the long hole 107*b*, and simultaneously the first and second follower portions 107*e* and 107*f* respectively come into contact with the first and second positioning surfaces 191*a* and 192*a*. As the first and second follower portions 107*e* and 107*f* respectively come into contact with the first and second positioning surfaces 191*a* and 192*a*, the pivot of the bearing member 107 and the door 103 in a counterclockwise rotation direction is restricted, and simultaneously the bearing member 107 (the door 103) is positioned at a predetermined position.

In addition, as the first and second follower portions 107*e* and 107*f* come into contact with the first and second cam portions 191 and 192, the cam 109 is interposed between the cam followers 107*d* at both sides of the longer side of the long hole 107*b*, and a movement of the hinge pin 153 along the longer side of the long hole 107*b* is restricted. As already described above, since a movement of the hinge pin 153 along a shorter side of the long hole 107*b* is also limited (restricted), movements of the hinge pin 153 along a rectangle and the shorter side of the long hole 107*b* are limited (restricted). Accordingly, the rattling of the shaft member 105 (the refrigerator main body 102) of the bearing member 107 (the door 103) into which the hinge pin 153 is inserted through the long hole 107*b* is prevented (as will be described below, a position of the bearing member 107 with respect to the shaft member 105, particularly a position of a rotational shaft (a rotational center) of the bearing member 107, is safely guided without rattling even in a state in which the door is not closed.

Accordingly, the bearing member 107 (the door 103) is positioned at a predetermined position without rattling. In this state, as long as the bearing member 107 (the door 103) does not pivot in the clockwise rotation direction to operate the cam unit C, the position is maintained.

As illustrated in FIGS. 4B and 4C, when the door 103 is opened from a closed state, the long hole 107*b*, the first follower portion 107*e*, and the second follower portion 107*f* are integrated and pivot together in the clockwise rotation direction.

The first cam surface 191*b* connected to the first positioning surface 191*a* is formed to have a thickness equal to or greater than the first positioning surface 191*a* when seen from the hinge pin center 153*a*. Accordingly, as the first follower portion 107*e* pivots in the clockwise rotation direction and comes into contact with the first cam surface 191*b* while being in contact with the first positioning surface 191*a*, the hinge pin 153 is separated from the first follower portion 107*e* along the longer side of the long hole 107*b*. Thus, the hinge pin 153 is moved from the first end portion P1 of the long hole 107*b* toward a side of the second end portion P2 by the above-described separation.

Meanwhile, the second cam surface 192*b* connected to the second positioning surface 192*a* is formed to have a thickness which gradually becomes thin in the clockwise rotation direction when seen from the hinge pin center 153*a*. Accordingly, as the second follower portion 107*f* pivots in the clockwise rotation direction and comes into contact with the second cam surface 192*b* while being in contact with the second positioning surface 192*a*, the hinge pin 153 approaches the second follower portion 107*f* along the longer side of the long hole 107*b*. Thus, the hinge pin 153 is moved from the first end portion P1 of the long hole 107*b* toward the side of the second end portion P2 by the above-described approach.

At this time, since the above-described long hole 107*b* also pivots together with the first and second follower portions 107*e* and 107*f* and the first and second follower portions 107*e* and 107*f* are respectively and normally in contact with the first and second cam surfaces 191*b* and 192*b*, movements of the hinge pin 153 along a longer side and the shorter side of the long hole 107*b* are restricted due to the same reason when the door 103 is in a closed state. Accordingly, the rattling of the bearing member 107 (the door 103) is prevented. In this state, as long as the bearing member 107 (the door 103) does not pivot in the clockwise rotation direction or counterclockwise rotation direction to operate the cam unit C, the position of the hinge pin 153 with respect to the long hole 107*b* may be maintained.

In addition, as already described above, when the door 103 is in a closed state, the long hole 107*b* of the bearing member 107 is arranged to extend in a forward or backward direction. At this time, since the hinge pin 153 is configured to be positioned at the first end portion P1 in which the door 103 and the refrigerator main body 102 move toward each other, when the door 103 is opened from a closed state, as the hinge pin 153 moves from the first end portion P1 of the long hole 107*b* toward the second end portion P2, the bearing member 107 (the door 103) may largely move forward with respect to the shaft member 105 (the refrigerator main body 102).

In the present embodiment, when the pivot angle of the bearing member 107 (the door 103) is 45°, although the hinge pin 153 reaches the second end portion P2, it is not limited thereto and may be suitably changed by changing an arrangements, a shapes, and the like of the cam 109 and the cam follower 107*d*.

The hinge pin 153 arrives at the second end portion P2, and simultaneously, as illustrated in FIG. 4C, the first and second follower portions 107*e* and 107*f* are configured to arrive at the first and second guide surfaces 191*c* and 192*c* at the same time.

Both of the first guide surface 191*c* connected from the first cam surface 191*b* and the second guide surface 192*c* connected from the second cam surface 192*b* are formed by extending along an arc centralized by a hinge pin center 153*a* to guide the bearing member 107 (the door 103) to pivot 90°. At this time, since the hinge pin 153 was separated from the first follower portion 107*e* to be close to the second follower portion 107*f*, the first guide surface 191*c* in contact with the first follower portion 107*e* is formed to have a diameter less than that of the second guide surface 192*c* in contact with the second follower portion 107*f* when seen from the hinge pin center 153*a*.

At this time, since the first and second follower portions 107*e* and 107*f* are configured to be normally in contact with the first and second guide surfaces 191*c* and 192*c*, the movement of the hinge pin 153 with respect to the long hole 107*b* is restricted by the same reason when the door 103 is opened from a closed state, and thus the rattling of the bearing member 107 (the door 103) is prevented.

In addition, since both of the first and second guide surfaces 191*c* and 192*c* have the same thickness when seen from the hinge pin center 153*a*, both of the first and second guide surfaces 191*c* and 192*c* do not have a function to move the hinge pin 153 with respect to the long hole 107*b*. While the first and second follower portions 107*e* and 107*f* are in contact with the first and second guide surfaces 191*c* and 192*c*, a position of the hinge pin 153 position is maintained at the second end portion P2.

As illustrated in FIG. 4D, when the door 103 is open, the first and second follower portions 107*e* and 107*f* respectively come into contact with the first and second rotation stop surfaces 191*d* and 192*d*. A pivot of the bearing member 107 (the door 103) in the clockwise rotation direction is restricted by the above-described contact, and simultaneously the bearing member 107 (the door 103) is positioned at a predetermined position.

In the present embodiment, although the bearing member 107 (the door 103) reaches an open state when the pivot angle is 135°, it is not limited thereto, and may be suitably changed by changing An arrangement, a shape, and the like of the cam 109 and the cam follower 107*d*.

At this time, since the first and second follower portions 107*e* and 107*f* are configured to respectively come into contact with the first and second rotation stop surfaces 191*d* and 192*d*, the bearing member 107 (the door 103) is positioned at a predetermined positioned without a rattling by the same reason when the door 103 is in a closed state. In this state, as long as the bearing member 107 does not pivot in the counterclockwise rotation direction to operate the cam unit C, the position is maintained.

In addition, a vertical height of the first and second follower portions 107*e* and 107*f* is formed to be equal to or less than a height of, for example, a step portion of the hinge pin 153. Accordingly, in a state in which the bearing plate portion 107*a* is inserted into the shaft member 105, both of the first and second follower portions 107*e* and 107*f* pivot without interfering with the hinge plate main body 151*a*.

An extended portion is formed at the first follower portion 107*e* to have a rectangular shape in a downward direction. One side positioned at a left side (an outside of the door 103 in a widthwise direction) of a peripheral of both left and right ends of the extended portion when the door 103 is in a closed state is configured as a stopper portion 107*g*. The stopper portion 107*g* is formed to come into contact with the a stopper support 151*e* of the hinge plate main body 151*a*, rotate, and stop in a state in which the door 103 is open to a maximum extent (in the present embodiment, corresponds to the pivot angle of the bearing member 107 is 135°). In addition, the stopper portion 107*g* is not limited to the above-described structure, and as long as the rotation of the door 103 is stopped by the interference between the bearing member 107 and the shaft member 105, an arrangement, a shape, and the like may be suitably changed.

In addition, a lip portion (not shown) in a hook type is formed at the bottom surface of the left end side of the door 103 and is configured to be engaged with the lip support 151*f* of the hinge plate main body 151*a* when the door 103 is in a closed state such that the door 103 is maintained to be in the closed state. In addition, the lip portion and the lip support 151*f* may not absolutely need to be installed, but an arrangement, a shape, and the like may also be changed suitably.

The length of the longer side of the long hole 107*b* of the upper hinge device 104 which supports the longer side door 103 from an upper side thereof is less than that of the long hole 107*b* of the lower hinge device 104 which has been described so far (not shown). Although dimensions of each of the portions constituting the cam unit C of the upper hinge device 104 may also be suitably changed by changing dimensions of the long hole 107*b*, the cam unit C of the upper hinge device 104 is configured to serve the same function as the cam unit C of the lower hinge device 104.

An entire operation when the door 103 of the refrigerator 101 is opened or closed will be described below with reference to the above-described embodiment. As long as there is no specific state, hereinafter, only the left door 103 (simply referred to as the door 103) and the lower hinge device 104 (simply referred to as the hinge device 104) of the door 103 will be described.

When the door 103 is in a closed state, that is, the pivot angle of the door 103 is 0° (see FIG. 4A), since the first and second follower portions 107*e* and 107*f* respectively come into contact with the first and second positioning surfaces 191*a* and 192*a*, a pivot of the bearing member 107 in the counterclockwise rotation direction is restricted, and a position is determined and maintained as a state in which the door 103 is closed. In this state, since the hinge pin 153 comes into contact with the first end portion P1 of the long hole 107*b*, the bearing member 107 is close to the shaft member 105, and the rear surface of the door 103 and the front surface of the refrigerator main body 102 around the opening 121*a* are close to each other. As illustrated in FIG. 6, since the magnet G2 of the gasket G1 mounted in the rear surface of the door 103 and the metallic plate of the front surface of the refrigerator main body 102 around the opening 121*a* adsorb to each other due to the above-described approach, the gasket G1 and the front surface are pressed against each other, and thus the storage compartment 121 of the refrigerator main body 102 is sealed from the outside. At this time, similarly, as illustrated in FIG. 6, since the facing surface 103*d* formed in the gasket G1 comes into contact with the front surface of the refrigerator main body 102 around the opening 121*a* in a faced state and simultaneously the throat side surface portion T2 of the throat portion T1 comes into contact with the wall surface in the storage compartment 121 in a faced state, a gap between an inner portion of the storage compartment 121 and the gasket G1 is sealed.

In addition, in the above-described state, since the lip portion mounted on the bottom surface of the left end side of the door 103 and the lip support 151*f* mounted on the hinge plate main body 151*a* are engaged with each other, the pivot of the bearing member 107 in the clockwise rotation direction is prevented, and a closed state of the door 103 is maintained.

When the door 103 is opened from a closed state (see FIG. 4B), since the engagement of the lip portion with the lip support 151*f* is released and the door 103 pivots in the clockwise rotation direction, the first and second follower portions 107*e* and 107*f* respectively come into contact with the first and second cam surfaces 191*b* and 192*b* in the clockwise rotation direction. Since the hinge pin 153 moves from the first end portion P1 of the long hole 107*b* toward the second end portion P2 due to the above-described contact, the bearing member 107 slides to push forward with respect to the shaft member 105, and the rear surface of the door 103 moves forward from the front surface of the refrigerator main body 102 around the opening 121*a* to be separated therefrom and pivots in the clockwise rotation direction. As the door 103 is separated therefrom, the gasket G1 is separated from the front surface of the refrigerator main body 102 around the opening 121*a* to release the sealing of the storage compartment 121 in the refrigerator main body 102, and simultaneously the facing surface 103*d* of the door 103 and the throat side surface portion T2 are also separated from the refrigerator main body 102 to release the sealing of a gap between the inner portion of the storage compartment 121 and the gasket G1.

In addition, as described above, since the length of the longer side of the long hole 107*b* of the upper hinge device 104 is less than that of the longer side of the long hole 107*b* of the lower hinge device 104, when the door 103 is opened from a closed state, the bearing member 107 of the lower hinge device 104 is pushed forward more than the bearing member 107 of the upper hinge device 104. Due to this, the lower end side of the rotational shaft of the door 103 protrudes more than the upper end side thereof, and thus the rotational shaft of the door 103 is inclined with respect to the vertical direction.

In a structure according to the present embodiment, the above-described separation operation occurs when the pivot angle of the door 103 reaches 45° from 0°. In addition, when the pivot angle reaches 45° (see FIG. 4C), the hinge pin 153 comes into contact with the second end portion P2 of the long hole 107*b*. Next, the first and second follower portions 107*e* and 107*f* respectively come into contact with the first and second guide surfaces 191*c* and 192*c* in the clockwise rotation direction, and thus the door 103 pivots along an arc shape.

In addition, when the door 103 is opened from the closed state as described above, the lower side rotational shaft protrudes forward more than the upper side rotational shaft, and thus the rotational shaft is inclined with respect to the vertical direction. Accordingly, when the door 103 is further opened from the above-described state, the door 103 is obliquely opened upward with respect to the horizontal surface according to a degree of inclination of the rotational shaft.

When the door 103 further pivots and the pivot angle reaches 135° (see FIG. 4D), since the first follower portion 107*e*, the second follower portion 107*f*, and the stopper portion 107*g* respectively come into contact with the first rotation stop surface 191*d*, the second rotation stop surface 192*d*, and the stopper support 151*e*, the pivot of the bearing member 107 in the clockwise rotation direction is restricted, and a position is determined and maintained as a state in which the door 103 is open.

An operation when the door 103 is closed from an open state is also the same as the above-described operation, as the door 103 pivots in the counterclockwise rotation direction, the first follower portion 107*e* sequentially comes into contact with the first guide surface 191*c* and the first cam surface 191*b* in the counterclockwise rotation direction to come into contact with the first positioning surface 191*a*, the second follower portion 107*f* sequentially comes into contact with the second guide surface 192*c* and the second cam surface 192*b* in the counterclockwise rotation direction to come into contact with the second positioning surface 192*a*, and the lip portion and the lip support 151*f* are engaged with each other.

Particularly, the pivot angle of the door 103 reaches 0° from 45°, the first and second follower portions 107*e* and 107*f* respectively come into contact along the first and second cam surfaces 191*b* and 192*b*, and the hinge pin 153 moves from the second end portion P2 of the long hole 107*b* to the first end portion P1 to come into contact with the first end portion P1 due to the contact. The bearing member 107 moves back to slide to approach the shaft member 105 due to the above-described movement, the rear surface of the door 103 approaches the front surface of the refrigerator main body 102 around the opening 121*a* to pivot in the counterclockwise rotation direction. In addition, as the magnet G2 of the gasket G1 mounted on the rear surface of the door 103 and the metallic plate of the front surface of the refrigerator main body 102 around the opening 121*a* are adsorbed to each other due to the approach, and the gasket G1 is pressed against a front surface around the opening 121*a* of the refrigerator main body 102, the storage compartment 121 in the refrigerator main body 102 is sealed from the outside. At this point, since the facing surface 103*d* and the front surface of the refrigerator main body 102 around the opening 121*a* come into contact with each other, and simultaneously the throat side surface portion T2 and the inner wall surface in the storage compartment 121 come into contact with each other, a gap between the inner portion of the storage compartment 121 and the gasket G1 is sealed again. In addition, the door 103 is closed from an open state to reach a closed state, as the hinge pin 153 and the first and second follower portions 107*e* and 107*f* respectively come into contact with the first end portion P1 of the long hole 107*b* and the first and second positioning surfaces 191*a* and 192*a*, the hinge pin 153 is positioned at the same position before the door 103 is opened.

In addition, the cam 109 is fixed in a state in which the cam 109 is placed on the hinge plate main body 151*a*, and meanwhile, the bearing member 107 is fixed in a state in which the bearing plate portion 107*a* is placed on the top surface of the cam 109 or the cam follower 107*d* comes into sliding contact with the cam 109. In addition, as illustrated in FIGS. 7A to 7D, the hinge plate main body 151*a* of the shaft member 105, the cam 109, and the bearing plate portion 107*a* of the bearing member 107 have an overlap region when seen from a direction in which the hinge pin center 153*a* (the vertical direction of the page of FIGS. 7A to D) extends regardless of the pivot angle of the door 103.

In the above-described first embodiment, contact points between the cam 109 and the cam follower 107*d* constituting the cam unit C are normally maintained when the door 103 is a closed state, an open state, and a middle state between open and closed state and operate in conjunction with contacts between the long hole 107*b* and the hinge pin 153 configured to be normally maintained in the same manner as the above-described states, and thus the gasket G1 and the refrigerator main body 102 come into contact with or separate from each other as necessity and by a predetermined timing, and it has advantages for the gasket G1 to be prevented from winding. Accordingly, since the gasket G1 may be provided at a side outer than a support point of the door 103 (the hinge pin center 153*a*), a space for largely securing the facing surface 103*d* formed inside of the gasket G1 in a widthwise direction of the door 103 may be obtained and thus the gap between the inner portion of the storage compartment 121 and gasket G1 is sufficiently sealed by the enlarged facing surface 103*d*, and the heat insulation property may be improved.

In addition, since a movement of not only the gasket G1 but also the facing surface 103*d* is guided, the facing surface 103*d* comes into contact with the front surface of the opening 121*a* of the refrigerator main body 102, and the heat insulation property of the refrigerator 101 is advantageously improved.

That is, since the cam 109 and the cam follower 107*d* are normally in contact with each other, an operation of the bearing member 107 with respect to the shaft member 105 is constantly maintained. Due to this, since not only a timing on which the gasket G1 and the refrigerator main body 102 come into contact with or separate from each other but also a track of the rotational center (the rotational shaft) of the door 103 and a track of the door when the door 103 is opened or closed are constantly maintained, an opening or closing operation is smooth, and thus a pleasant opening or closing sensation is provided to a user, and simultaneously an accuracy of a positioning of the door 103 is advantageously improved. Due to this, since the facing surface 103*d* comes into contact with the front surface of the refrigerator main body 102 around the opening 121*a* with a sufficient accuracy of the positioning to seal the facing surface 103*d* and the front surface of the refrigerator main body 102 around the opening 121*a*, a predetermined heat insulation property is advantageously obtained.

In addition, since the hinge device 104 according to the embodiment is configured to determine a position in a state in which the door 103 is in a closed state by a contact point between the cam 109 and the cam follower 107*d* without using a pressed member, an accuracy of a positioning of the facing surface 103*d* with respect to the front surface of the refrigerator main body 102 of the opening 121*a* is advantageously maintained and the accuracy of a positioning is advantageously stabilized without a reduction of the heat insulation property (a reduction of a positioning property of the door 103) due to the deterioration of the pressed member.

In addition, since a contact portion between the first follower portion 107*e* and the first cam portion 191, a contact portion between the second follower portion 107*f* and the second cam portion 192, a portion between an outer circumferential surface of the hinge pin 153 and an inner circumferential surface of the long hole 107*b* are configured to be normally maintained, and contacts of the three contact portions are maintained, the rattling of the door 103 is advantageously prevented and an opening or closing operation is advantageously stabilized.

Particularly, in the present embodiment, as the first and second follower portions 107*e* and 107*f* respectively come into contact with the first and second cam portions 191 and 192, since the cam follower 107*d* comes into contact with the cam 109 to interpose the cam 107 therebetween, a movement of the hinge pin 153 is particularly advantageously restricted. In addition, since a contact portion between the cam 109 and the cam follower 107*d* is maintained such that a contact portion between the outer circumferential surface of the hinge pin 153 and the inner circumferential surface of the long hole 107*b* further restricts the movement of the hinge pin 153, an operation of the bearing member 107 with respect to the shaft member 105 is constantly maintained, and a rattling of the door 103 is further advantageously prevented.

In addition, as the first and second follower portions 107*e* and 107*f* are respectively installed at both sides of the longer side of the long hole 107*b*, since a direction in which the hinge pin 153 is inserted between the first and second follower portions 107*e* and 107*f* is approximately perpendicular to a direction in which an inner circumferential surface of the shorter side of the long hole 107*b* comes into contact with the outer circumferential surface of the hinge pin 153, a contact portion between the cam 109 and the cam follower 107*d* are normally maintained, and thus an operation of bearing member 107 with respect to the shaft member 105 is constantly maintained, and a rattling of the door 103 is advantageously prevented.

Since a sliding contact between the first cam portion 191 and the first follower portion 107*e* and a contact portion between the and second cam portion 192 and the second follower portion 107*f* are configured to respectively contribute to the positioning of the door 103 and a movement of the hinge pin 153, and the first and second follower portions 107*e* and 107*f* are configured to sequentially and continuously come into contact with the first positioning surface 191*a*, the first cam surface 191*b*, the second positioning surface 192*a*, and the second cam surface 192*b* of the cam 109 which perform each of functions, when the door 103 is opened from a closed state, the hinge pin 153 is moved almost simultaneously when the door 103 is opened, and the gasket G1 may be quickly separated from door 103. Similarly, when the door 103 is closed, the gasket G1 may also be pressed against the refrigerator main body 102 by the hinge pin 153 being moved just before a position is determined as a state in which the door 103 is in a closed state. By configuring like this, the gasket G1 is further advantageously prevented from winding due to an opening or closing of the door 103.

In addition, the first and second follower portions 107*e* and 107*f* are respectively configured to simultaneously pass through the first and second cam surfaces 191*b* and 192*b* to smoothly guide a movement of the hinge pin 153.

In addition, as the cam 109 and the cam follower 107*d* are respectively divided into two portions as the first and second cam portions 191 and 192 and the first and second follower portions 107*e* and 107*f*, since loads applied to the cam 109 and the cam follower 107*d* according to an opening or closing of the door 103 are dispersed, an abrasion may be restrained, rattling may be prevented, and simultaneously durability of the cam 109 and the cam follower 107*d* may be improved.

In addition, the door 103 is configured to maintain a state in which the door 103 is in a closed state by positioning surfaces for determining a position as a state in which the door 103 is in a closed state being formed at two portions, that is, the first positioning surface 191*a* and the second positioning surface 192*a*, the accuracy of the positioning of the door 103 is advantageously stabilized.

In addition, regarding a rotation stop surface for determining a position as a state in which the door 103 is open, since the first and second rotation stop surfaces 191*d* and 192*d* are formed on the first and second cam portions 191 and 192, and a load applied to the cam 109 and the cam follower 107*d* when the door 103 reaches an open state are dispersed, durability of the cam 109 and the cam follower 107*d* as a rotation stop for the door 103 may be improved.

In addition, since the first and second rotation stop surfaces 191*d* and 192*d*, the stopper portion 107*g*, and the stopper support 151*e* are used together, the load may be further dispersed, and the durability may be further improved. The above-describe structure has an advantage over others to apply the present invention to a high capacity refrigerator.

Since the cam unit C is configured to separate the stopper portion 107*g* and the hinge pin 153 from each other when the door 103 is opened from a closed state, when the door 103 reaches an open state, the load applied to a stopper portion 107*g* may be reduced by a contact between the stopper portion 107*g* and the stopper support 151*e*, and durability of the hinge device 104 may be improved.

In addition, since the length of the longer side of the long hole 107*b* of the lower hinge device 104 is greater than that of the longer side of the long hole 107*b* of the upper hinge device 104, when the door 103 is opened, the lower side bearing member 107 moves to push forward more than the upper side bearing member 107. Accordingly, the door 103 is obliquely opened upward from the horizontal surface. Accordingly, an interference between the door 103 and the upper end loading door 103*a* disposed under the door 103 may be prevented, and a gap between doors that are the door 103 and the upper end loading door 103*a* may be small.

In addition, when the door 103 is in an open state, the middle state between open and closed states, and a closed state, since the hinge plate main body 151*a* and the cam 109 of the shaft member 105, and the bearing plate portion 107*a* of the bearing member 107 have an overlap region in any state of the door 103 when seen from a direction in which the hinge pin center 153*a* parallel to the rotational center of the door 103 extends, a structural strength of the entire hinge device 104 may be improved. Accordingly, a mechanical strength of the hinge device 104 may be also secured, and the hinge plate main body 151*a*, the cam 109, and the bearing plate portion 107*a* may be thinly formed.

In addition, as known from FIGS. 7A to 7D, since the door 103 largely slides forward in a direction in which the long hole 107*b* extends, even when the door rotates 90° or more from a closed position, the door 103 may be opened to open position (135°)° without interference between an end portion of the support side of the door 103 (the bearing member 107) and each portion (the attachment plate 151*b* of the shaft member 105) of the refrigerator main body 102. By preventing the interference, the first embodiment has an advantage to sufficiently open the opening 121*a* of the refrigerator 101.

Hereinafter, a modified embodiment partially modified from the first embodiment will be described.

An arrangement, a shape, and the like of the facing surface 103*d* and the throat side surface portion T2 installed on the door 103 may be suitably changed as long as an arrangement and the shape contribute to a heat insulation property. For example, in consideration of an accuracy of assembly and a tolerance of dimension of each element of the refrigerator 101 according to the present invention and an opening and closing track of the door 103, when the door 103 is in a closed state, the facing surface 103*d* and the throat side surface portion T2 may be configured to respectively be close to the front surface of the refrigerator main body 102 around the opening 121*a* and the wall surface in the storage compartment 121 to a maximum extent. In this case, a gap portion which extends from the inner portion of the storage compartment 121 to the gasket G1 is formed and heat inflow which flows into the storage compartment 121 from the outside through the gasket G1 and a cold air leak from the inner portion of the storage compartment 121 to the outside may be prevented according to a width and the length of the gap portion.

In addition, in the present embodiment, the installed door pocket forming portion T may also be used for providing an accommodation space on the rear surface of the door 103. Instead of the present structure, the door pocket forming portion T, that is, the throat portion T1, may also not be provided, and only the facing surface 103*d* may be arranged. In addition, even when the door pocket forming portion T is provided, the throat side surface portion T2 of the throat portion T1 constituting the door pocket forming portion T may be configured not to come into contact with or be close to the wall surface in the storage compartment 121, and only the facing surface 103*d* may be configured to come into contact with or be close to the front surface of the refrigerator main body 102 around the opening 121*a* when the door 103 is in a closed state.

In the present embodiment, although the door 103 which opens or closes the first opening 121*a* is formed in a type with both sides opening, it is not limited to the present structure. For example, the door 103 may be a type with one side opening in which one side, a left or a right portion, of the first opening 121*a* is supported by a shaft.

In addition, although all of the doors which open or close the second to fourth openings may be a drawer type, it is not limited to the present structure. For example, the door which opens or closes the first opening 121*a* may be formed using a known structure, and any one of the second to fourth openings may be formed with the type with both sides opening or the type with one side opening having the hinge structure according to the present invention.

In the present embodiment, although the shaft member 105 is fixed to the refrigerator main body 102 and the bearing member 107 is fixed to the door 103, it is not absolutely limited to the present structure. The shaft member 105 may be configured to be fixed to the door 103, and the bearing member 107 may be configured to be fixed to the refrigerator main body 102.

In addition, the bearing member 107 may be configured to be provided with the cam 109, and the shaft member 105 may be configured to be provided with the cam follower 107*d*.

In the present embodiment, although the cam 109 is divided into the first and second cam portions 191 and 192, and the cam follower 107*d* is divided into two portions as the first and second follower portions 107*e* and 107*f* respectively in contact with the first and second cam portions 191 and 192, it is not absolutely limited the present structure. An arrangement, a shape, and the like of the cam 109 and the cam follower 107*d* may be suitably changed.

In addition, an arrangement, a shape, and the like of the hinge pin 153 and the long hole 107*b* formed in the hinge pin 153 may also not be limited to the present embodiment, and may be suitably changed. For example, a track when door 103 is opened or closed may be adjusted by changing the length and a direction of the longer side of the long hole 107*b*.

In addition, although the first and second cam portions 191 and 192 are respectively divided into the first positioning surface 191*a*, the first cam surface 191*b*, and the first guide surface 191*c* with which the first follower portion 107*e* sequentially comes into contact, and the second positioning surface 192*a*, the second cam surface 192*b*, and the second guide surface 192*c* with which the second follower portion 107*f* sequentially comes into contact, it is not absolutely limited to the present structure. An arrangement, a shape, and the like of each of the surfaces may be suitably changed. For example, a timing with which the gasket G1 is separated from the refrigerator main body 102 or a separation speed thereof may be changed by changing the curvature and the size or the like of the first cam surface 191*b*.

In the present embodiment, although the first and second rotation stop surfaces 191*d* and 192*d* are respectively formed in the first and second cam portions 191 and 192, it is not limited to the present structure. For example, the rotation stop surface may be formed at one direction of the first and second cam portions 191 and 192, or the rotation stop surface may not be formed and only the stopper portion 107*g* and the stopper support 151*e* may be used.

In addition, when the present embodiment is used for a small capacity refrigerator, instead of the structure of the present embodiment, the stopper portion 107*g* and the stopper support 151*e* may not be provided, and only the rotation stop surface formed in at least one direction of the first and second rotation stop surfaces 191*d* and 192*d* may be used. In this case, hinge device 104, furthermore, the refrigerator 101 are advantageously miniaturized and lightened. An arrangement, a shape, and the like of both of the first and second rotation stop surfaces 191*d* and 192*d* may not be limited to the present embodiment and may be suitably changed.

In addition, even when the stopper portion 107*g* and the stopper support 151*e* are installed, the cam unit C does not need to absolutely separate the stopper portion 107*g* and the hinge pin 153 from each other.

The upper hinge device 104 may also be formed using a known hinge device. In this case, at least the upper side shaft member 105 having the hinge pin 153 and the upper side bearing member 107 having a circular hole which relatively pivotably supports the hinge pin 153 are needed in the upper hinge device 104, one direction of the upper side shaft member 105 and upper side bearing member 107 is fixed to the refrigerator main body 102, and the other direction is fixed to the door 103. Even in this structure, since the door 103 is obliquely opened upward, interference between the door 103 and the upper end loading door 103*a* disposed under the door 103 may be prevented, a gap between the door 103 and the upper end loading door 103*a* may be small.

In addition, even when both of the upper and lower hinge devices 104 and 104 are formed according to the present invention, the length of the longer side of the long hole 107*b* of the lower hinge device 104 does not absolutely need to be greater than the length of the longer side of the long hole 107*b* of the upper hinge device 104. Only the upper hinge device 104 may be provided as the hinge device 104 according to the present invention.

In addition, as a direction in which the long hole 107*b* extends and a structure of the cam unit C is changed, when the door 103 is opened from a closed state, the door 103 may be largely slid toward an outside in a widthwise direction of the refrigerator main body 102. In this case, as a structure in which a pair of gaskets are provided on facing side surfaces (side surfaces of arc sides) of both the left and right doors 103 and 103 is used together, when the door 103 is opened, a pair of gaskets G4 are moved without interfering with each other.

The present invention is applied not only to the refrigerator but also to a storage whose at least one direction of a left and a right portions is swingably supported using an upper and a lower hinge devices.

Second Embodiment

A second embodiment described below is illustrated in FIGS. 8 to 16. Hereinafter, although a main structure of a refrigerator 201 according to the second embodiment will be described, descriptions of portions which are adopted known structures or the same structures as those of the first embodiment may be omitted.

As illustrated in FIG. 8, the refrigerator 201 according to the present embodiment is provided with at least a refrigerator main body 202 having a refrigerator compartment 221 at an upper portion, a door 203 which closes a front surface opening 221*a* (hereinafter, simply referred to as an opening) installed at a front surface of the refrigerator compartment 221, and a hinge device 204 installed by being interposed between the refrigerator main body 202 and the door 203.

The door 203 has a lateral opening or closing type including a left door 231 and a right door 232 which close the opening 221*a* from both left and right sides. In addition, a gasket G3 pressed against an opening edge of a front surface of the refrigerator main body 202 at a closed position Q1 at which the door 203 closes the opening 221*a* is mounted on a rear surface which is a surface of a side of the refrigerator main body 202 of the left and right doors 231 and 232. In addition, a pair of gaskets G4 pressed against each other are mounted on facing side surfaces of the left and right doors 231 and 232 (side surfaces of arc sides of each of the doors).

In addition, as illustrated in FIG. 8, the hinge devices 204 are installed by being interposed between an upper and a lower left end portions of the left door 231 and the refrigerator main body 202 and between an upper and lower right end portions of the right door 232 and the refrigerator main body 202 and supports the door 203 to freely rotate between the closed position Q1 and an open position Q3 in which the door 203 opens the opening 221*a* (Here, the rotation includes not only one directional circular movement but also a bidirectional, including a forward and a backward directions, circular movement. Hereinafter, the bidirectional circular movement is referred to as a pivot.). In addition, the open position Q3 is a position to which each of the doors 231 and 232 rotates, for example, 135° from the closed position Q1. Specifically, the hinge devices 204 are installed by being interposed between bottom surfaces of the left and right doors 231 and 232 and an upper surface of the refrigerator main body 202 which faces the bottom surfaces, and between top surfaces of the left and right doors 231 and 232 and a lower surface of the refrigerator main body 202 which faces the top surfaces.

In the present embodiment, the hinge devices 204 installed at the upper and the lower end portions of the doors 231 and 232 have the same structure. Specifically, as illustrated in FIGS. 9 to 16, the hinge device 204 includes a main body side member 205 mounted on the refrigerator main body 202, a link member 209 as an intermediate member rotatably installed at the main body side member 205 by a fixing pin 206, a door side member 207 rotatably installed at the link member 209 by a swing pin 208 and mounted on the door 203, and a slide unit R which is installed by being interposed between the main body side member 205 and the door side member 207, and guides a track (an operation) of the door side member 207 with respect to the main body side member 205.

Hereinafter, each of the portions 205 to 209 and the slide unit R and the like will be described in detail.

The main body side member 205 includes an attachment plate 251 fixed to the refrigerator main body 202 by, for example, a screw, and having, for example, a zinc alloy for die casting 2 (ZDC2) material, and, for example, a main body side plate 252 detachably installed at the attachment plate 251. Particularly, as illustrated in FIG. 11, the main body side plate 252 includes an accommodation space 252*s* which movably accommodates the link member 209, and includes a first plate element 252*e* having a plane plate shape to form the accommodation space 252*s* and having, for example, a steel plate cold commercial (SPCC), and a second plate element 252*f* having a plane plate shape and having a resin material for example including polyacetal (POM) and the like. The link member 209 is installed between the plates 252*e* and 252*f* by the fixing pin 206 to freely rotate. In addition, a portion which connects the first plate element 252*e* and the second plate element 252*f* is formed using, for example, a ZDC2.

As illustrated in FIGS. 10, 15, and 16, the fixing pin 206 is mounted at a portion of the refrigerator main body side of the main body side plate 252. The main body side plate 252 according to the present embodiment has an outline in a fan shape (a central angle is about 90°) when seen in a plan view, and the fixing pin 206 is mounted at a vicinity of each portion of the center of the main body side plate 252.

As illustrated in FIGS. 9 and 11, the link member 209 has a plane plate shape, and is connected to the main body side plate 252 by the fixing pin 206 mounted on the main body side plate 252 to be capable of sliding and rotating with respect to the main body side plate 252. In the closed position Q1, the link member 209 is in an accommodated state in the accommodation space 252*s* of the main body side plate 252, and at the open position Q3, the link member 209 is in a state in which a part of the link member 209 comes out from the accommodation space 252*s* of the main body side plate 252 and the remaining part is accommodated in the accommodation space 252*s*.

In addition, the swing pin 208 which rotatably connects the door side member 207 is mounted in the link member 209. The swing pin 208 is installed at a portion opposite to the refrigerator main body side in the link member 209 (that is, a front side portion of the link member when seen from the refrigerator main body 202). In the present second embodiment, a direction toward an opposite side and the opposite side of the refrigerator main body 202 are respectively referred to as an outward direction and an outer side.

Regarding a positional relationship between the swing pin 208 and the fixing pin 206, at least in the closed position Q1, the swing pin 208 is configured to be positioned at a side outer than the fixing pin 206 with respect to a side of the refrigerator main body 202 (an opening 221*a*). In the present embodiment, from the closed position Q1 to the open position Q3, the swing pin 208 is configured to be positioned at an outer side (a front side when seen from the refrigerator main body 202) compared to the fixing pin 206 with respect to the front surface opening 221*a* (see FIGS. 13 to 16).

In the closed position Q1, since the link member 209 according to the present embodiment is accommodated in the accommodation space 252*s* of the main body side plate 252, the swing pin 208 extends upward more than a top surface of the main body side plate 252 (a door side surface, see FIG. 11). In addition, a notch portion (not shown) is formed at the second plate element 252*f* of the main body side plate 252, so that a movement of the swing pin 208 is not interfered.

As illustrated in FIG. 9, the door side member 207 has a plane plate shape having, for example, a steel use stainless (SUS) or, for example, a SPCC which is heat-treated by carburizing and is connected by the swing pin 208 mounted on the link member 209 to be capable of sliding and rotating with respect to the link member 209.

Here, in the present embodiment, as illustrated in FIG. 12, the attachment plate 251 of the main body side member 205, the main body side plate 252 and the link member 209 of the main body side member 205, and the door side member 207 are configured to be separable from each other. That is, the attachment plate 251 of the main body side member 205 and the main body side plate 252 are configured to be separable from each other. Specifically, the main body side plate 252 is configured to be detachably mounted on a mounting surface which is set as a surface of an opposite side to the refrigerator main body side on the attachment plate 251, and a convex portion X1 installed on one direction in the attachment plate 251 or the main body side plate 252 and a concave portion X2 installed on the other direction in the attachment plate 251 or the main body side plate 252 are provided. In the present embodiment, the convex portion X1 is installed on the first plate element 252*e* of the main body side plate 252, and the concave portion (through hole) X2 which is interlocked with the convex portion X1 is installed in the attachment plate 251. As above-described, since the attachment plate 251 of the main body side member 205, the main body side plate 252 and the link member 209 of the main body side member 205, and the door side member 207 are configured to be separable, the door 203 may be easily installed on the refrigerator main body 202.

As illustrated in FIGS. 13 to 16, in the closed position Q1 to the middle position Q2 on which the door 203 rotates from the closed position Q1 to a predetermined angle, the slide unit R is configured such that the door side member 207 rotates about the fixing pin 206 as a main rotational shaft with the link member 209 with respect to the main body side member 205, and in the middle position Q2 to the open position Q3 on which the door 203 opens the front surface opening 221*a*, the slide unit R is configured such that a rotation of the link member 209 about the fixing pin 206 is allowed, and the door side member 207 rotates about the swing pin 208 as a main rotational shaft with respect to the link member 209.

Here, the middle position Q2 is a position in which the pair of gaskets G4 mounted on both facing sides of the left and right doors 231 and 232 are separated from each other and, in the present embodiment, is a position on which the door 203 rotates from the closed position Q1 (a rotational angle is 0°) to, for example, 4° (a rotational angle is 4°).

Specifically, as illustrated in FIGS. 13 to 16, the slide unit R is provided with the guide pin (the slide pin) 253 mounted on the main body side member 205 and a guide hole (the slide hole) 207*b* configured to be formed in the door side member 207 wherein a guide pin 253 is contactable with the guide hole (the slide hole) 207*b*.

Since the guide pin 253 as a sliding portion mounted on the main body side member 205 and the guide hole 207*b* as a slid portion mounted on the door side member 207 come into contact with each other, the door side member 207 is supported to be relatively movable in a direction in which the guide hole 207*b* extends with respect to the main body side member 205 and to be capable of relatively pivoting about the guide hole 207*b*.

The guide pin 253 is installed to be fixed to first plate element 252*e* of the main body side plate 252 and simultaneously to pass through the second plate element 252*f* to extend upward from a top surface of the second plate element 252*f* (the door side surface). As described above, since the guide pin 253 is fixed to the first plate element 252*e*, a swing slide hole 209*h* with which the guide pin 253 comes into contact is formed in the link member 209 (see FIG. 10). A track of the link member 209 is also guided by the guide pin 253 due to the swing slide hole 209*h*.

That is, although the door 203 is configured to freely pivot about the fixing pin 206 and the swing pin 208 (double shafts structure), the slide unit R guides a pivot angle of the link member 209 around the fixing pin 206 and a pivot angle of the door side member 207 around the swing pin 208 according to an opening and a closing movements of the door to be changed according to a predetermined rule based on a structure of the slide unit R. Accordingly, opening and closing operations of the door side member 207 or the door 203 are stabilized.

Specifically, regarding a shape of the guide hole 207*b*, a curvature thereof in a range in which the door moves from the closed position Q1 to the middle position Q2 is less than that of a range in which the door moves from the middle position Q2 to the open position Q3 (see FIG. 12 and the like). That is, in the range in which the door moves from the closed position Q1 to the middle position Q2, the door side member 207 is configured to rotate about the fixing pin 206 as a main rotational shaft with the link member 209. Meanwhile, in the range in which the door moves from the middle position Q2 to the open position Q3, the link member 209 is configured to rotate about the fixing pin 206, and the door side member 207 is configured to rotate about the swing pin 208 as a main rotational shaft. In addition, when the door moves to the open position Q3, a terminal portion of the guide hole 207*b* is configured to come into contact with the guide pin 253 and to restrict a further movement of an opening of the door.

Even when the door moves from the open position Q3 or the middle position Q2 to the closed position Q1, the slide unit R achieves the same operational effect as above described. That is, in a range between the open position Q3 and the middle position Q2, since the link member 209 is configured to rotate about the fixing pin 206 and the door side member 207 is configured to rotate about the swing pin 208 as a main rotational shaft and the door is further closed, when the door moves from the middle position Q2 to the closed position Q1, the door side member 207 is configured to rotate about the fixing pin 206 as a main rotational shaft with the link member 209. In addition, when the door moves to the closed position Q1, a starting end portion of the guide hole 207*b* is configured to come into contact with the guide pin 253 to restrict a further movement of the door.

In addition, a base end portion of the guide pin 253 is fixed to the first plate element 252*e*, and meanwhile, a locking portion 253*a* for preventing a separation from the guide hole 207*b* is formed at a leading end portion. The locking portion 253*a* is formed in a circular plate shape having a diameter greater than the width of the guide hole 207*b*.

In addition, as illustrated in FIG. 16, at the open position Q3, a part of the main body side member 205, a part of the link member 209, and a part of the door side member 207 are overlapped with respect to a shaft direction of the swing pin 208 (the fixing pin 206). As described above, at the open position Q3, since the main body side member 205, the link member 209, and the door side member 207 have overlapping parts, a mechanical strength of the hinge device 204 may be enhanced at the open position Q3. As a result, the mechanical strength of the hinge device 204 may be secured, and the main body side member 205, the link member 209, and the door side member 207 may be thin.

In addition, as known from FIGS. 13 to 15, even in the closed position Q1 and the middle position Q2, a part of the main body side member 205, a part of the link member 209, and a part of the door side member 207 are overlapped with respect to a shaft direction of the swing pin 208 (the fixing pin 206). Accordingly, not only in the open position Q3 but also in the closed position Q1 and the middle position Q2, a mechanical strength of the hinge device 204 is secured as described above.

In the present embodiment, as illustrated in FIG. 9 a sub-slide unit S for preventing an interlocking of the door side member 207 which may occur in the slide unit R while moving is further installed in the above-described structure.

The sub-slide unit S is installed by being interposed between the main body side member 205 and the door side member 207 and disposed at an outer in a diameter direction side than the slide unit R with respect to the swing pin 208. Specifically, the sub-slide unit S is provided with a sub-guide pin 51 mounted on a bottom surface of the door side member 207, and a sub-guide groove S2 configured to be come into contactable with the sub-guide pin 51. The sub-guide groove S2 is formed in the top surface of the second plate element 252*f* of the main body side plate 252 of the main body side member 205. The sub-slide unit S according to the present embodiment is configured to guide the door 203 to pass from the closed position Q1 through the middle position Q2 to a state in which the door 203 rotates a predetermined angle.

Next, an opening or closing operation of the door 203 configured as described above is described.

First, in a state in which the left and right doors 231 and 232 are closed, the refrigerator compartment 221 of the refrigerator 201 is in a sealed state by gaskets G3 mounted on rear surfaces of the left and right doors 231 and 232 and the pair of gaskets G4 mounted on the facing side surfaces of the left and right doors 231 and 232. When at least one direction of the left and right doors 231 and 232 is opened from the above-described state, the door side member 207 and the link member 209 rotate about the fixing pin 206 as a main rotational shaft to the middle position Q2 by the slide unit R (FIGS. 13 and 14). That is, to the middle position Q2, since the door side member 207 and the link member 209 rotate about the fixing pin 206 as a main rotational shaft which is close to the refrigerator main body 202, an end portion of the gasket G4, mounted on the side surface of the door 203 of a side of the opening 221*a* is swelled to a side of the door of the other direction and the door side member 207, and the link member 209 may not rotate. Accordingly the gaskets G4 mounted on the left and right doors 231 and 232 is in a completely separated state without an interference with each other.

Next, when the door 203 is further opened, that is, the door 203 rotates past the middle position Q2, the link member 209 rotates about the fixing pin 206 by the slide unit R, and the door side member 207 rotates about the swing pin 208 as a main rotational shaft (FIGS. 15 and 16). Accordingly, when the door 203 rotates more than 90° from a closed state such that the main rotational shaft of the door side member 207 moves from the fixing pin 206 close to the opening 221*a* to the swing pin 208 far from the opening 221*a*, the door 203 may be opened to a predetermined angle (for example, 135°) without an interference between an end portion of a support side of the door 203 and any portion of the refrigerator main body 202.

In the above-described second embodiment, the fixing pin 206 pivotably supports the link member 209 with respect to the main body side member 205, and simultaneously pivotably supports the door side member 207 with respect to the link member 209. Accordingly, a rotational center of the door side member 207 is movable along a track defined by a relative pivot angle of the link member 209 with respect to the main body side member 205 and a relative pivot angle of the door side member 207 with respect to the link member 209. Accordingly, a timing at which a rotational center is changed between the center of the fixing pin 206 and the center of the swing pin 208 or a track on which each center moves based on an opening or closing operation of the door 203 are guided. In addition, the slide unit R supports the door side member 207 to be capable of relatively pivoting and relatively moving with respect to the main body side member 205 to guide the timing or the track. In the present structure, since the slide unit R guides a relative pivot of the link member 209 with respect to the main body side member 205 based on an opening or closing operation of the door 203 and a relative pivot of the door side member 207 with respect to the link member 209, the opening or closing operation of the door 203 with respect to the refrigerator main body 202, that is, the track on which the rotational center of the door 203 moves, may be stabilized regardless of the relative pivot angle of the door 203 without rattling.

In addition, since the guide pin 253 and the guide hole 207*b* are normally in a sliding contact with each other, the slide unit R operates anytime when the door 203 is at the closed position Q1, the middle position Q2, or the open position Q3. Thus, a rattling of the door 203 is advantageously prevented.

In addition, since the door side member 207, furthermore, the door 203, is supported by the swing pin 208, the guide pin 253, and the fixing pin 206, a positioning and opening or closing operation of the door 203 may be stabilized without rattling.

In addition, since a load applied when the door 203 is opened or closed is dispersed between the fixing pin 206 and swing pin 208, mechanical strength may be improved compared with a hinge device having one rotational shaft.

Configured as described above, since a movement when the door 203 is opened or closed is relatively precisely adjusted, a track to prevent an interference between the gaskets G4 mounted on the facing side surfaces of the left and right doors 231 and 232 as will be described below is further advantageously adjusted, or a track to prevent an interference between an end portion of the support side of the door 203 and each portion of the refrigerator main body 202 is further advantageously adjusted.

In the refrigerator 201 to which the hinge device 204 configured as describes above is applied, when each of the left and right doors 231 and 232 is positioned between the closed position Q1 and a predetermined middle position Q2, since each of the left and right doors 231 and 232 rotates about the fixing pin 206 disposed at a side of the refrigerator main body 202, a part of the gasket G4 is prevented from being close to the other side door between the closed position Q1 and the predetermined middle position Q2. Accordingly, interference during opening or closing occurs due to a contact and the like between the pair of gaskets G4 mounted between the facing side surfaces of the left and right doors 231 and 232 may be prevented.

In addition, when the door 203 is positioned between the middle position Q2 and open position Q3, since the door 203 rotates about the swing pin 208 disposed at a side outer than the fixing pin 206 with respect to the refrigerator main body 202, the door 203 may be separated from the refrigerator main body 202 and may rotate. Accordingly, interference between the end portion of the support side of the door 203 and each portion of the refrigerator main body 202 may be prevented, and thus an opening of the refrigerator 201 may be opened sufficiently.

As described above, since guide by the slide unit R and pivot of the pivot link member 209 operate in conjunction with each other, the door 203 pivots while changing the rotational shaft of the door 203 between a rotational shaft around the fixing pin 206 disposed at a side of the refrigerator main body 202 and a rotational shaft around the swing pin 208 disposed at a side outer than the fixing pin 206 with respect to the refrigerator main body 202 by an opening or closing operation of the door 203. Thus, interference between the pair of gaskets G4 mounted between the facing side surfaces of the left and right doors 231 and 232 may be prevented, and interference between the end portion of the support side of the door 203 and each portion of the refrigerator main body may also be prevented.

In addition, since the guide pin 253 is configured to come into contact with both end portions of a longer side of the guide hole 207*b* in every case in which the door 203 reaches the open position Q3 and the closed position Q1, both end portions of the door 203 is used as a rotation stop, and thus a positioning property at the open position Q3 and the closed position Q1 of the door 203 is improved, and simultaneously the hinge device 204 is advantageously to compactly constituted and the mechanical strength is improved.

In addition, since the locking portion 253*a* is provided at a leading end of the guide pin 253, separation of the guide pin 253 from the guide hole 207*b* is prevented. For example, a state in which the guide pin 253 is separated from the guide hole 207*b* by the door 203 floating upward due to an impact of a contact between the guide pin 253 and one end portion of the guide hole 207*b* when the door 203 is rotated by a strong force may be prevented.

Hereinafter, a modified embodiment from the second embodiment will be described.

Although the slide unit R is provided with the guide pin 253 and the guide hole 207*b* in the above-describe embodiment, the guide hole 207*b* may also include a guide groove (a slide groove) formed in the bottom surface of the door side member 207. In addition, the guide pin 253 may be mounted on the door side member 207, or the guide hole 207*b* or the guide groove (the slide groove) may also be installed in the main body side member 205.

In addition, although the main body side plate 252 of the main body side member 205 according to the above-described embodiment includes the accommodation space 252*s*, the link member 209 may also rotate by sliding on the top surface of the main body side plate 252 without the accommodation space 252*s*.

In addition, although a cooling storage according to the above-described embodiment includes a refrigerator compartment and a freezer compartment, the cooling storage may only include a refrigerator compartment, or may also be a freezer storage including only a freezer compartment.

Third Embodiment

A third embodiment which will be described below is illustrated in FIGS. 17 to 25. Hereinafter, although a main structure of a refrigerator 301 according to the third embodiment will be described, descriptions of portions which adopt known structures or the same structures as those of the first and the second embodiments may be omitted.

As illustrated in FIG. 17, the refrigerator 301 according to the present embodiment is provided with at least a refrigerator main body 302 having a refrigerator compartment 321 at an upper portion, a door 303 which closes a front surface opening 321*a* (hereinafter, simply referred to as an opening) installed at a front surface of the refrigerator compartment 321, and a hinge device 304 installed by being interposed between the refrigerator main body 302 and the door 303.

The door 303 has a lateral opening or closing type including a left door 331 and a right door 332 which close the opening 321*a* from both left and right sides. In addition, a gasket G5 pressed against an opening edge of a front surface of the refrigerator main body 302 at a closed position M1 at which the door 303 closes the opening 321*a* is mounted at a rear surface which is a surface of a side of the refrigerator main body 302 of the left and right doors 331 and 332. In addition, a pair of gaskets G6 pressed against each other are mounted on facing side surfaces of the left and right doors 331 and 332.

In addition, As illustrated in FIG. 17, the hinge devices 304 are installed by being interposed between an upper and a lower left end portions of the left door 331 and the refrigerator main body 302, and between a upper and lower right end portions of the right door 332 and the refrigerator main body 302, and supports the door 303 to freely rotate between the closed position M1 and an open position M3 in which the door 303 opens the opening 321*a* (Here, the rotation includes not only one directional circular movement but also a bidirectional, including a forward and a backward directions, circular movement. Hereinafter, the bidirectional circular movement is referred to as a pivot.). In addition, the open position M3 is a position that each of the doors 331 and 332 rotates to, for example, 135° from the closed position M1. Specifically, the hinge devices 304 are installed by being interposed between bottom surfaces of the left and right doors 331 and 332 and an upper surface of the refrigerator main body 302 which faces the bottom surfaces and between top surfaces of the left and right doors 331 and 332 and a lower surface of the refrigerator main body 302 which faces the top surfaces.

In the present embodiment, the hinge devices 304 installed at the upper and the lower end portions of the doors 331 and 332 have the same structure. Specifically, as illustrated in FIGS. 18 to 20, the hinge device 304 includes a main body side member 305 mounted on the refrigerator main body 302, a link member 309 as an intermediate member rotatably installed at the main body side member 305 by a fixing pin 306, a door side member 307 rotatably installed at the link member 309 by a swing pin 308 and mounted on the door 303, and a slide unit N which is installed by being interposed between the main body side member 305 and the door side member 307, and guides a track (an operation) of the door side member 307 with respect to the main body side member 305.

Hereinafter, each of the portions 305 to 309, the slide unit N and the like will be described in detail.

The main body side member 305 includes a main body side plate 352 fixed to the refrigerator main body 302 by, for example, a screw, and having, for example, a ZDC2 material. An accommodation space 352*s* is formed at the main body side plate 352 to pivotably accommodate the link member 309. As illustrated in FIG. 18B, the accommodation space 352*s* is configured to have a space in a thin box shape having an open bottom at a bottom surface of the main body side plate 352. A through hole (not shown) is formed around each portion of a forward direction in a forward or backward direction (hereinafter, the forward or backward direction is referred to as a direction of a forward or backward direction of the refrigerator 301 and the refrigerator main body 302, and the forward direction is referred to as, for example, a direction opposite a direction of a side of the refrigerator main body in FIG. 18.) when seen from the refrigerator main body 302 and an inner side in a widthwise direction (hereinafter the widthwise direction is referred to as a widthwise direction of the refrigerator 301 and the refrigerator main body 302, that is, a lateral direction of a page of FIG. 17, and a vertical direction of a page of FIG. 21, and an inner side and outer side are respectively referred to as a lower side and an upper side of a page of FIG. 21) in the accommodation space 352*s* to attach the fixing pin 306. The through hole vertically penetrates the main body side plate 352, and the link member 309 is supported by the fixing pin 306 inserted into the through hole to be capable of pivoting around the fixing pin 306 with respect to the main body side member 305.

As illustrated in FIGS. 18 to 20, the fixing pin 306 is positioned at a front side of the main body side plate 352 when seen from the refrigerator main body 302 and is mounted on a peripheral region of approximately a central portion in a widthwise direction.

As illustrated in FIGS. 18 to 20, the link member 309 is formed approximately in a fan shape when seen from a plane surface and is supported to be capable of pivoting by the fixing pin 306 at a vicinity of each portion of the center of the link member 309. The link member 309 is configured to pivot in a limited range by an inner wall portion of the accommodation space 352*s*.

Specifically, in the closed position M1 of the door 303, the link member 309 is in a state in which the link member 309 is in contact with a wall portion (not shown) of one direction positioned at an inner side in a widthwise direction in an inner wall portion widened in a forward or backward direction of the accommodation space 352*s* and in the middle position M2 in which the door 303 rotates a predetermined angle from the closed position M1 in the other direction, since the link member 309 pivots about the fixing pin 306 in the clockwise rotation direction of a page of FIG. 21 as will be described below, the link member 309 is in a state in which the link member 309 is in contact with a wall portion (not shown) in one direction positioned at a front side in a forward or backward direction in an inner wall portion widened in a widthwise direction of the accommodation space 352*s*. In the present embodiment, a state in which the link member 309 is accommodated in the accommodation space 352*s* is normally maintained regardless of an opening or closing of the door 303 unlike the link member 209 according to the second embodiment.

In addition, As illustrated in FIGS. 20 and 21, a swing guide hole 352*v* is formed at a region outer than the fixing pin 306 in the main body side member 305 in a widthwise direction of the refrigerator main body 302. The swing guide hole 352*v* which is a long hole to allow the link member 309 to pivot about the fixing pin 306 is formed to have an exterior in an arc extending approximately in a forward or backward direction.

The swing guide hole 352*v* penetrates from a top surface of the main body side member 305 to the accommodation space 352*s*, and a swing pin 308 which is configured to be fixed to the door side member 307 and protrudes downward more than the lower end portion of the door side member 307 is inserted into the swing guide hole 352*v*. The swing pin 308 extends from the main body side member 305 to an inner portion of the accommodation space 352*s* and mounted on a swing end portion of the link member 309 to be relatively pivoting capable with respect to the link member 309. That is, as the swing pin 308 is involved, the door side member 307 and the link member 309 are relatively movable along the swing guide hole 352*v* and are connected to be relatively pivoting capable around the swing pin 308.

In addition, as is known from a region in which the swing guide hole 352*v* is formed, the swing pin 308 is arranged at a side outer than the fixing pin 306 in a widthwise direction of the refrigerator main body 302 even considering a movement of the swing pin 308 according to an operation of the door side member 307.

In addition, the length of the swing guide hole 352*v* corresponds to a pivot range of the link member 309, in the closed position M1, the swing pin 308 comes into contact with an end portion P4 of a corner side of a page of FIG. 20 of the swing guide hole 352*v* (one rear end portion when seen from the refrigerator main body 302), and at the middle position M2 in which the link member 309 and the swing pin 308 pivots a predetermined angle in the other direction of the clockwise rotation direction of a page of FIG. 21, the swing pin 308 comes into contact with a front end portion P3 of a front side of the page of FIG. 20 of the swing guide hole 352*v* (one front end portion when seen from the refrigerator main body 302). In the present embodiment, a range of a movement of the swing pin 308 is restricted by the length of the swing guide hole 352*v*, and a state in which the swing pin 308 comes into contact with the one front end portion P3 of the swing guide hole 352*v* is maintained from the middle position M2 to the open position M3 unlike the swing pin 208 according to the second embodiment.

As illustrated in FIG. 20 and the like, the door side member 307 is a plane plate shape having, for example, a steel use stainless (SUS) or, for example, a SPCC which is heat-treated by carburizing, and is provided with a support plate 371 mounted on a lower end portion of the door 303 and a guide plate 372 mounted on a bottom surface of the support plate 371 and placed on the top surface of the main body side member 305. A unit hole is formed in the guide plate 372 for attaching the swing pin 308, and as described above, as the link member 309 and the door side member 307 are connected each by the swing pin 308, the door side member 307 is connected to be relatively capable of relatively pivoting with respect to the link member 309 mounted at a side of a bottom surface of the main body side member 305 and is integrally connected to the link member 309 to be capable of sliding along the swing guide hole 352*v* formed in the main body side member 305.

In addition, as illustrated in FIG. 20, a guide hole (slide hole) 307*b* which extends approximately in a "<" shape in a forward or backward direction is formed in the guide plate 372 of the door side member 307, and as a guide pin (a slide pin) 353 mounted on the top surface of the main body side member 305 is inserted, the guide hole 307*b* and the guide pin 353 constitute the slide unit N.

In addition, as the guide pin 353 as a sliding portion mounted on the main body side member 305 and guide hole 307*b* as a slid portion formed in the door side member 307 come into contact with each other, the door side member 307 is connected to not only the link member 309 but also the main body side member 305. The door side member 307 is supported to be relatively movable with respect to the main body side member 305 in a direction in which the guide hole 307*b* extends, and to be capable of relatively pivoting around the guide hole 307*b*.

As illustrated in FIGS. 21 to 24, in a range between the closed position M1 and a middle position M2 in which the door 303 rotates a predetermined angle from the closed position M1, the slide unit N guides the link member 309 to pivot about the fixing pin 306 in a rotation direction opposite to a rotation direction of the door 303 with respect to the main body side member 305 in conjunction with an opening operation of the door 303. By the above-described pivot, the slide unit N guides the swing pin 308 attached to the link member 309 to move from the end portion P4 of a rear side of the swing guide hole 352*v* to the end portion P3 of a front side thereof and guides the door side member 307 to pivot around the moving swing pin 308. In addition, in a range between the middle position M2 and the open position M3, the slide unit N guides the door side member 307 to pivot about the swing pin 308 which has moved to the end portion P3 of the front side.

Here, the middle position M2 is a position in which the pair of gaskets G6 mounted on the facing side surfaces of the left and right doors 331 and 332 separated from each other, and in the present embodiment, the door 303 rotates, for example, 15° (a rotation angle is 15°) from the closed position M1 (a rotation angle is 0°).

Specifically, the guide pin 353 is mounted at a front side of a top surface of the main body side plate 352 and, as illustrated in FIG. 20, is fixed at a slightly right side of a mounting position of the fixing pin 306 and at a slightly left of the front end portion P3 of the swing guide hole 352*v*. A guide pin 353 is configured to be fixed to protrude upward from the main body side plate 352, and a guide hole 307*b* is formed in the door side member 307 mounted on the main body side plate 352 in a state in which the door side member 307 is placed on the main body side plate 352 such that the guide pin 353 is inserted into the guide hole 307*b* to be contactable therewith (see FIG. 20)

In addition, although the door 303 is configured to freely pivot around the fixing pin 306 and the swing pin 308 (although double shafts), the slide unit N guides a pivot angle of link member 309 around the fixing pin 306 and a pivot angle of door side member 307 around the swing pin 308 to be changed based on a predetermined rule by a movement of an opening or closing of the door and a structure of the slide unit N. Thus, an opening or closing operation of the door side member 307 or the door 303 is stabilized.

As illustrated in FIG. 21, when the door 303 is in the closed position M1, the guide hole 307*b* is formed in approximately a "<" shape which curves toward an inner side in a widthwise direction of the refrigerator main body 302. In addition, in a range in which the door 303 moves from the closed position M1 to the middle position M2, a shape of the guide hole 307*b* has a more gentler curve than that in a range in which the door 303 moves from the middle position M2 to the open position M3 (see FIGS. 21 and 22).

In addition, as illustrated in FIGS. 21 and 24, when the door 303 reaches the closed position M1 and the open position M3, front and rear ends N1 and N2 of the guide hole 307*b* are configured to come into contact with the guide pin 353 to prevent an excessive opening or closing operation of the door 303.

Specifically, in a range in which the door 303 moves from the closed position M1 to the middle position M2, that is, a section from one end portion N1 of a front side of the guide hole 307*b* to approximately a central portion thereof, the guide hole 307*b* is formed on an arc which extends centralized by the rotational shaft O1 positioned at a side outer than the swing pin 308 in a widthwise direction of the refrigerator main body 302 or a rear side of the swing pin 308 in a forward or backward direction of the refrigerator main body 302. Meanwhile, in a range in which the door 303 moves from the middle position M2 to the open position M2, that is, from approximately the central portion of the guide hole 307*b* to the other end portion N2 of a rear side thereof, the guide hole 307*b* is formed on an arc which extends around the center O2 of the swing pin 308 and has a curvature greater than that of the range when the door 303 moves from the closed position M1 to the middle position M2 (see FIGS. 22 to 24). By configuring as described above, the slide unit N shows further useful effects as described below when applied to a storage in which the gaskets G5 and G6 are mounted.

In addition, the base end portion of the guide pin 353 is fixed to the top surface of the main body side plate 352, and meanwhile a locking portion 353*a* is installed at the leading end portion to prevent the guide pin 353 from separating from the guide hole 307*b*. As illustrated in FIG. 20, the locking portion 353*a* is formed in a circular plate shape to have a diameter greater than the width of the guide hole 307*b*.

In addition, as illustrated in FIG. 24, in the open position M3, a part of the main body side member 305, a part of the link member 309, and a part of the door side member 307 are overlapped when seen from a shaft of the swing pin 308. As described above, at the open position M3, since the main body side member 305, the link member 309, and the door side member 307 have an overlapped part, mechanical strength of the hinge device 304 at the open position M3 may be improved. As a result, the mechanical strength of the hinge device 304 is secured and the main body side member 305, the link member 309, and the door side member 307 may be thin.

In addition, As illustrated in FIGS. 21 to 23, in the closed position M1 and the middle position M2, a part of the main body side member 305, a part of the link member 309, and a part of the door side member 307 are also overlapped when seen from the shaft of the swing pin 308 (the fixing pin 306). Accordingly, in not only the open position M3 but also the closed position M1 and the middle position M2, an effect of securing mechanical strength of the hinge device 304 such as above-described is shown.

In the present embodiment, as illustrated in FIGS. 20 and 21, a sub-slide unit V for preventing locking of the door side member 307 in the slide unit N in the above-described structure while moving is further included.

The sub-slide unit V is installed by being interposed between the main body side member 305 and the door side member 307 and arranged at an a side outer than the slide unit N in a diameter direction (inner side in a widthwise direction) when seen from the swing pin 308. Specifically, the sub-slide unit V is provided with a sub-guide pin V1 which is protrusively mounted on the top surface of the main body side plate 352 of the main body side member 305 and a sub-guide groove V2 configured to be contactable with the sub-guide pin V1. The sub-guide groove V2 corresponding to the sub-guide pin V1 is formed on a bottom surface of the guide plate 372 of the door side member 307. The sub-slide unit V according to the embodiment of the present invention is configured to guide an opening or closing operation in a section from the closed position M1 to the middle position M2 of the door 303 unlike the sub-slide unit S according to the second embodiment.

Next, an opening or closing operation of the door 303 when the hinge device 304 having the above-described structure is applied will be described.

First, the refrigerator compartment 321 of the refrigerator 301 is in a sealed state due to the gaskets G5 mounted on a rear surface of the left and right doors 331 and 332, and the pair of gaskets G6 mounted on the facing side surfaces of the left and right doors 331 and 332 in a state in which the left and right doors 331 and 332 are in a closed state. When at least one direction of the left and right doors 331 and 332 is opened from this state, as the slide unit N operates, the door side member 307 moves toward the one end portion P3 of the swing guide hole 352*v* along an arc centralized by a rotational shaft O1 positioned at a side outer than the swing pin 308 in a widthwise direction of the refrigerator main body 302 and a rear side in a forward or backward direction of the refrigerator main body 302 and rotates around the swing pin 308 to the middle position M2 (see FIGS. 21 and 22). At this point, since the link member 309 rotates about the fixing pin 306 in a direction opposite a direction of the door side member 307, the link member 309 guides a movement of the swing pin 308, furthermore, an opening operation of the door side member 307 to be performed smoothly such that rattling along the swing pin 308, furthermore, the door side member 307, and a long side of the swing guide hole 352*v* is prevented. That is, since the door 303 moves along an arc centralized by a shaft O1 closer to a side of the refrigerator main body 302 than the fixing pin 306 and the swing pin 308, an end portion of the gasket G6, mounted on a side surface of the door 303, of a side of the opening 321*a* may be bulged toward a side of the door of the other direction compared to when the door 303 rotates along an arc around a center O2 of the swing pin 308, and may not rotate to the middle position M2 (As indicated by an arrow A in FIG. 25, when the door 303 is opened from the closed position M1, the end portion moves along a track which curves toward an outside in a widthwise direction.). Accordingly, the gaskets G6 mounted on the facing side surfaces (arcs) of the left and right doors 331 and 332 move without interfering with each other.

In addition, since the entire door side member 307 is guided to move along the arc centralized by the rotational shaft O1, a rear surface of the door 303 moves to be far from the front surface of the refrigerator main body 302. As illustrated in FIGS. 21 and 22, as the rotational shaft O1 is positioned at a side outer than the swing pin 308 in a widthwise direction of the refrigerator main body 302, since the entire door 303 moves along an arc around the rotational shaft O1, the rear surface of the door 303 slides to comparatively greatly push forward from an edge of the front surface opening of the refrigerator main body 302 compared to when the door rotates along an arc around the center O2 of the swing pin 308. Accordingly, the gasket G5 mounted on the rear surface of the door 303 moves from an edge of the front surface opening of the refrigerator main body 302.

Next, when the door 303 is further opened, that is, reaches the middle position M2, the swing pin 308 comes into contact with an end portion P3 of a front side of the swing guide hole 352*v*, and simultaneously the link member 309 also comes into contact with an inner wall portion (not shown) of the accommodation space 352*s*, as illustrated in FIG. 22. In a region from the middle position M2 to the closed position M3, since the guide hole 307*b* extends along an curve of an arc shape around the center O2 of the swing pin 308, the door side member 307 rotates about the center O2 in this region (see FIGS. 22 and 23). At this point, since a state in which the swing pin 308 is in contact with the end portion P3 of the front side of the swing guide hole 352*v* is maintained and accordingly a state in which door 303 slid forward from the front surface of the refrigerator main body 302 is also maintained, when the door 303 rotates 90° or more from the closed position, an end portion of a support side of the door 303 and each portion of the refrigerator main body 302 may be opened to a predetermined angle without interference (for example, 135°).

In addition, when the door 303 in opened to the open position M3, the end portion N2 of the guide hole 307*b* and the guide pin 353 come into contact with each other to restrict a further opening operation (FIG. 24).

As described in the above-described third embodiment, the link member 309 is supported to be capable of pivoting with respect to the main body side member 305 by the fixing pin 306, and simultaneously the door side member 307 is supported to be capable of pivoting with respect to the link member 309. Accordingly, the rotational center of the door side member 307 moves along a track defined by a relative pivot of the link member 309 with respect to the main body side member 305 and a relative pivot of the door side member 307 with respect to the link member 309, and thus a timing that the rotational center is changed between the rotational shaft O1 positioned at an outer side of the swing pin 308 in a widthwise direction of the refrigerator main body 302 as well as a rear side of the swing pin 308 in a forward or backward direction of the refrigerator main body 302, and the center O2 of the swing pin 308 or a track in which the center O2 of the swing pin 308 moves according to an opening or closing operation of the door 303 are guided. In addition, the door side member 307 is supported to be relatively pivoting capable and movable with respect to the main body side member 305 by the slide unit N. In the structure according to the present embodiment, since a relative pivot angle of the link member 309 with respect to the main body side member 305 and a relative pivot angle of the door side member 307 with respect to the link member 309 according to an opening or closing operation of the door 303 each precisely guides a predetermined track, the slide unit N may stabilize an opening or closing operation of the door 303 with respect to the refrigerator main body 302, that is, a track in which the rotational center of the door 303 moves regardless of the relative pivot angle of the door 303 and without rattling.

In addition, since the door side member 307, and furthermore, the door 303, is supported by the swing pin 308, the guide pin 353, and the fixing pin 306, positioning and opening or closing operation of the door 303 are stabilized without rattling.

In addition, since the guide pin 353 and the guide hole 307*b* are normally in contact with each other, the slide unit N normally operates anytime when the door 303 is positioned at the closed position M1, the middle position M2, and the open position M3. Accordingly, rattling of the door 303 is advantageously prevented, and an opening or closing operation of the door 303 is advantageously stabilized.

In addition, since a load applied when the door 303 is opened or closed is dispersed between the fixing pin 306 and the swing pin 308, mechanical strength may be improved compared to when a hinge device has one rotational shaft.

Since a movement when the door 303 is opened or closed is comparatively and precisely adjusted by configuring as describe above, a track is further advantageously adjusted to prevent interference between the gaskets G5 mounted on the facing side surfaces of the left and right doors 331 and 332 or between an end portion of the support side of the door 303 and each portion of the refrigerator main body 302 as will be described below.

In the refrigerator 301 to which the above-described hinge device 304 is applied, when each of the left and right doors 331 and 332 is positioned between the closed position M1 and a predetermined middle position M2, the door side member 307 rotates by sliding about the rotational shaft O1 along an arc, wherein the rotational shaft O1 is closer to the refrigerator main body 302 than the swing pin 308 in a forward or backward direction of the refrigerator main body 302. As operated in an above-described manner, in the closed position M1 to the predetermined middle position M2, a movement in which a part of the gaskets G6 is closer to the other side door may be prevented. Accordingly, interference in an opening or closing that occurs due to contact and the like between the pair of gaskets G6 mounted between the facing side surfaces of the left and right doors 331 and 332 may be prevented. In addition, since the entire door side member 307 slides approximately forward along an arc centralized by the rotational shaft O1 positioned at a side outer than the swing pin 308 in a widthwise direction of the refrigerator main body 302, the gasket G5 mounted on the rear surface of the door 303 moves to be separated from an opening edge of the front surface of the refrigerator main body 302. By moving as described above, when the door 303 is opened from the closed position M1, a state in which the gasket G5 interferes with and is wound around the opening edge of the front surface of the refrigerator main body 302 by a rotation of the door 303 may be prevented.

In addition, since the door 303 is positioned between the middle position M2 and the open position M3 and rotates about the center O2 of the swing pin 308 which was moved to the end portion P3 of the front side, the door 303 may be separated from the refrigerator main body 302 and may be rotated. Accordingly, since interference between the end portion of the support side of the door 303 and each portion of the refrigerator main body 302 is prevented, the opening of the refrigerator 301 may be opened sufficiently.

As described above, since the guide of the slide unit N and the pivot of the link member 309 are in conjunction with each other, the rotational center of the door side member 307 may be switched between the rotational shaft O1 positioned at a side outer than the swing pin 308 in a widthwise direction of the refrigerator main body 302 as well as a rear side in a forward or backward direction of the refrigerator main body 302 and the center O2 of the swing pin 308 and the door side member 307 may pivot due to an opening or closing operation of the door 303. Accordingly, the interference between the pair of gaskets G6 mounted on the facing side surfaces of the left and right doors 331 and 332 may be prevented, and the interference between the end portion of the support side of the door 303 and each portion of the refrigerator main body 302 may be prevented. In addition, since the rear surface of the door 303 is separated from the front surface of the refrigerator main body 302, a state in which the gasket G5 mounted on the rear surface interferes with and is wound around the front surface of the refrigerator main body 302 may be prevented.

In addition, when the door 303 reaches the closed position M1 and the open position M3, since the guide pin 353 is configured to come into contact with both end portions N1 and N2 of the guide holes 307*b*, and the end portions N1 and N2 are used as a rotation stop for the door 303, the positioning property of the door 303 at the closed position M1 and the open position M3 is improved. Simultaneously, the hinge device 304 is compactly configured, and mechanical strength is also advantageously improved.

In addition, since the locking portion 353*a* is mounted on a leading end of the guide pin 353, separation of the guide pin 353 from the guide hole 307*b* is prevented. For example, a state in which the guide pin 353 is separated from the guide hole 307*b* by the door 303 floating upward due to an impact of contact between the guide pin 353 and the end portion N2 of the guide hole 307*b* when the door 303 is rotated by a strong force is prevented.

Since the link member 309 is configured to pivot in a rotational direction opposite to a direction in which the door 303 is opened or closed, the swing pin 308 may be greatly moved forward, and an amount of a movement of the link member 309 according to a rotational direction of the door 303 may be reduced. Accordingly, the exposure of the link member 309 of the main body side member 305 may be prevented and the design property of the hinge device 304 may be improved.

Hereinafter, a modified embodiment from the third embodiment will be described below In the present embodiment, when the door 303 is opened form the closed position M1, the door 303 may be comparatively and greatly slid forward. Accordingly, since the gasket G5 of the rear surface of the door 303 may be arranged at a side outer than the fixing pin 306 or the swing pin 308 in a widthwise direction of the refrigerator main body 302, a facing surface which is in contact with or close to the opening edge of the front surface of the refrigerator main body 302 at the closed position in the first embodiment may be installed at the rear surface of the door 303. Thus, a heat insulation property of the refrigerator may be improved.

In the above-described embodiment, although the slide unit N is provided with the guide pin 353 and the guide hole 307*b*, the guide hole 307*b* may include a guide groove (a slide groove) formed on the bottom surface of the guide plate 372 of the door side member 307. In addition, the guide pin 353 is mounted on the door side member 307, and the guide hole 307*b* or the guide groove (the slide groove) may be formed in the main body side member 305.

In addition, although the main body side plate 352 of the main body side member 305 according to the above-described embodiment is configured to include the accommodation space 352*s*, the accommodation space 352*s* may not be formed, and the link member 309 may also be configured to pivot along the bottom surface of the main body side plate 352.

In addition, although a cooling storage according to the above-described embodiment includes a refrigerator compartment and a freezer compartment, the cooling storage may only include a refrigerator compartment but also a freezer storage including only a freezer compartment.

The invention claimed is:

1. A refrigerator comprising:

a refrigerator main body provided with a storage compartment including an opening;

a door which opens or closes the storage compartment; and a hinge device provided between the opening and the door, wherein the hinge device includes:

a main body side member mounted on the refrigerator main body and provided with a slide pin fixing portion;

a door side member mounted on the door and provided with a hole and a cam follower; and an intermediate member provided with a slide pin and a cam, and installed on the main body side member and installed in the door side member, the slide pin is insertable in the hole of the door side member to contact the hole, the slide pin is insertable on the slide pin fixing portion of the main body side member, and the cam comes into contact with the cam follower of the door side member, wherein, an opening or closing operation of the door causes a sliding contact of the slide pin of the intermediate member and the hole of the door side member in conjunction with contact between the cam of the intermediate member and the cam follower of the door side member, a rotational center of the door with respect to the refrigerator main body moves along a predetermined track formed by movement of the hole with respect to the refrigerator main body, the cam is provided with a first cam portion and a second cam portion, and the cam follower is provided with a first follower portion and a second follower portion respectively in contact with the first cam portion and the second cam portion, the first follower portion is provided in a rectangular thin plate shape, the first cam portion includes a positioning surface having a plane surface which comes in contact with the first follower portion to maintain the door at a closed position, and the rectangular thin plate shape of the first follower portion rests parallel against the plane surface of the first cam surface at the closed position.

2. The refrigerator of claim 1, wherein the contact between the slide pin and the hole and the contact between the cam follower of the door side member and the cam of the intermediate member are maintained when the door is at the closed position, as the door moves from the closed position to an open position, and when the door is at the open position.

3. The refrigerator of claim 1, wherein the main body side member, the intermediate member and the door side member include an overlapping region in a widthwise direction of a rotational shaft of the door when the door is at the closed position, as the door moves from the closed position to an open position, and when the door is at the open position.

4. The refrigerator of claim 1, wherein the cam follower is in contact with the cam of the intermediate member when the door is at the closed position, as the door moves from the closed to an open position, and when the door is at the open position; and the cam and the cam follower move the slide pin from a first end portion of the hole to a second end portion of the hole in conjunction with the door which opens and closes.

5. The refrigerator of claim 4, wherein:

the hinge device is provided to maintain the first follower portion in contact with the first cam portion, an inner circumferential surface of the hole in contact with an outer circumferential surface of the slide pin, and the second follower portion in contact with the second cam portion when the door is at the closed position, as the door moves from the closed position to the open position, and when the door is at the open position.

6. The refrigerator of claim 5, wherein the positioning surface of the first cam portion is a first positioning surface, and the first cam portion further includes:

a first cam surface which comes into contact with the first follower portion to move the slide pin from the first end portion of the hole to the second end portion; and a first guide surface having an arc shape centralized by the slide pin positioned at the second end portion of the hole, wherein the first follower portion is provided to sequentially move in a state in which the first follower portion comes into contact with the first positioning surface, the first cam surface, and the first guide surface as the door moves from the closed position to the open position; and the second cam portion includes:

a second positioning surface having a concave shape which comes into contact with the second follower portion to maintain the door at the closed position;

a second cam surface which comes into contact with the second follower portion to move the slide pin from the first end portion of the hole to the second end portion; and a second guide surface having an arc shape centralized by the slide pin positioned at the second end portion of the hole, wherein the second follower portion is provided to sequentially move in a state in which the second follower portion comes into contact with the first positioning surface, the second cam surface, and the second guide surface as the door moves from the closed position to the open position.

7. The refrigerator of claim 4, wherein:

the door side member includes a stopper portion which comes into contact with the main body side member to maintain the door at the open position, wherein a distance between a contact portion where the stopper portion comes into contact with the main body side member and the slide pin when the door is at the open position is greater than a distance between a contact portion where the stopper portion comes into contact with the main body side member and the slide pin when the door is at the closed position.

8. The refrigerator of claim 1, wherein the second follower portion is provided in a cylindrical shape.

9. A refrigerator which comprises a hinge device provided between a refrigerator main body provided with a storage compartment including an opening, and a door which opens or closes the storage compartment, wherein the hinge device comprises:

a main body side member mounted on the refrigerator main body;

a door side member mounted on the door and comprising a hole and a cam follower; and an intermediate member provided with a cam and a slide pin, the intermediate member installed on the main body side member and installed in the door side member, the cam of the intermediate member extends around the slide pin, wherein:

the slide pin is inserted in the hole to be relatively pivotable and simultaneously relatively movable, in an opening or closing operation of the door, a state in which at least a part of the main body side member, a part of the door side member, and a part of the intermediate member are overlapped is maintained at a rotational center of the door, the opening or closing operation of the door causes a sliding contact of the slide pin and the hole in conjunction with contact between the cam of the intermediate member and the cam follower of the door side member, and the rotational center of the door with respect to the refrigerator main body moves according to an extent of the opening or closing operation of the door, the cam is provided with a first cam portion and a second cam portion, and the cam follower is provided with a first follower portion and a second follower portion respectively in contact with the first cam portion and the second cam portion, the first follower portion is provided in a rectangular thin plate shape, the first cam portion includes a positioning surface having a plane surface which comes in contact with the first follower portion to maintain the door at a closed position, the rectangular thin plate shape of the first follower portion rests parallel against the plane surface of the positioning surface of the first cam portion at the closed position.

10. The refrigerator of claim 9, further comprising:

a gasket provided on a rear surface of the door to seal a gap between a front surface of the refrigerator main body and a rear surface of the door around the opening when the door closes the opening; and wherein the cam and the cam follower:

move the slide pin to a first end portion of the hole and separates the gasket from the front surface of the refrigerator main body as the door moves from the closed position to an open position, and move the slide pin to a second end portion of the hole and brings the gasket into contact with the front surface of the refrigerator main body as the door moves from the open position to the closed position.

11. The refrigerator of claim 9, wherein the second follower portion is provided in a cylindrical shape.

* * * * *